United States Patent [19]

Yamada

[11] Patent Number: 4,724,771

[45] Date of Patent: Feb. 16, 1988

[54] CLOSED-LOOP AMUSEMENT RIDE SYSTEM

[75] Inventor: Kazuo Yamada, Tokyo, Japan

[73] Assignee: Togo Japan Inc., Tokyo, Japan

[21] Appl. No.: 891,247

[22] Filed: Jul. 29, 1986

[30] Foreign Application Priority Data

| | | | |
|---|---|---|---|
| Jul. 31, 1985 | [JP] | Japan | 60-168977 |
| Sep. 10, 1985 | [JP] | Japan | 60-137572[U] |
| Sep. 30, 1985 | [JP] | Japan | 60-149487[U] |
| Apr. 30, 1986 | [JP] | Japan | 61-98244 |
| May 15, 1986 | [JP] | Japan | 61-71875[U] |
| Jun. 4, 1986 | [JP] | Japan | 61-85182[U] |

[51] Int. Cl.[4] ..... A63G 21/10

[52] U.S. Cl. ..... 104/56; 104/85; 104/127; 104/172.2; 187/71

[58] Field of Search ..... 104/53, 55, 63, 67, 104/74–76, 85, 100, 127, 129, 172.2, 139, 140, 165, 172.1, 172.3, 172.4; 105/156; 187/71, 20

[56] References Cited

U.S. PATENT DOCUMENTS

| | | | |
|---|---|---|---|
| 814,939 | 3/1906 | Cerruti | 104/74 |
| 862,237 | 8/1907 | Coyner | 104/140 |
| 1,783,268 | 12/1930 | Traver | 104/76 |
| 1,906,763 | 5/1933 | Maynes | 104/63 X |
| 2,642,005 | 6/1953 | Cooper | 104/63 |
| 3,858,518 | 1/1975 | Nyman | 104/173.1 X |
| 3,874,302 | 4/1975 | Crosswhite | 104/172.3 |
| 3,889,605 | 6/1975 | Bacon | 104/63 X |
| 4,170,943 | 10/1979 | Achrekar | 104/56 |
| 4,548,136 | 10/1985 | Yamada | 104/63 X |

FOREIGN PATENT DOCUMENTS

| | | | |
|---|---|---|---|
| 50-102434 | 8/1975 | Japan . | |
| 51-00531 | 9/1976 | Japan . | |
| 2109252 | 6/1983 | United Kingdom | 104/53 |

*Primary Examiner*—Robert B. Reeves
*Assistant Examiner*—Scott H. Werny
*Attorney, Agent, or Firm*—Merchant, Gould, Smith, Edell, Welter & Schmidt

[57] ABSTRACT

An amusement ride system according to the present invention comprises a pair of rails extending at a fixed distance from each other, and a passenger car located between the rails and traveling along the rails. A plurality of wheel units are provided on either side portion of the car, along the rails. Each wheel unit includes a set of wheels, which are in rolling contact with each corresponding rail, so as to hold it between them. The middle portion of the rail pair is twisted around a central axis between the rails, thus forming at least one twist region. As the car runs past the twist region of the rails, therefore, it is rotated around the central axis, following the twist of the rails.

15 Claims, 46 Drawing Figures

FIG. 31
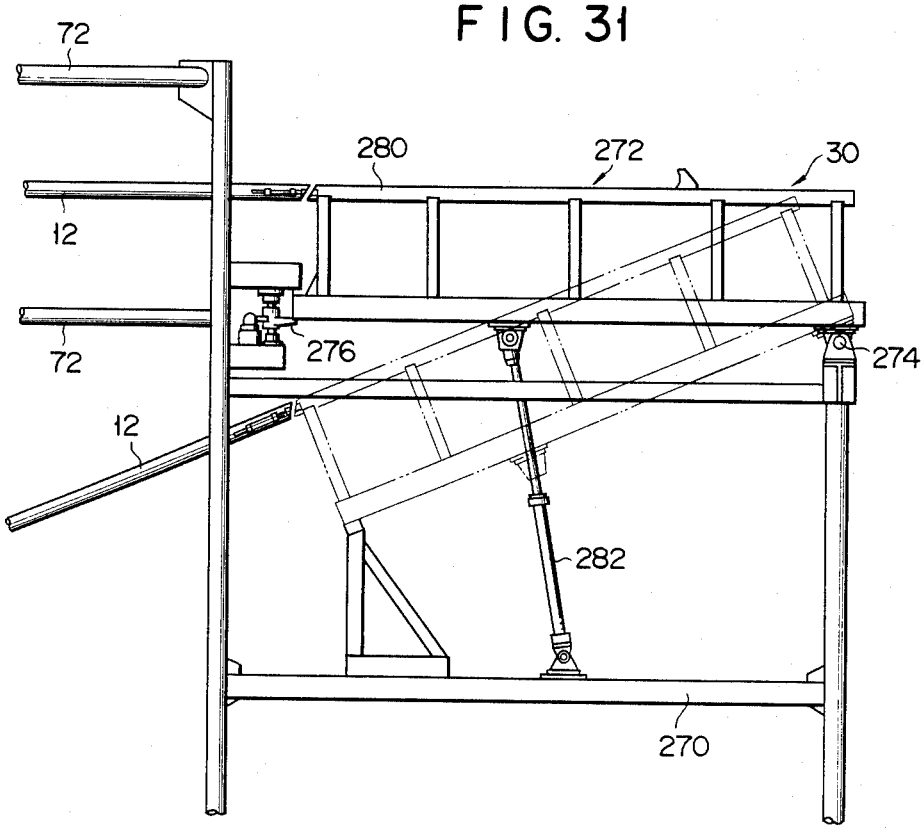
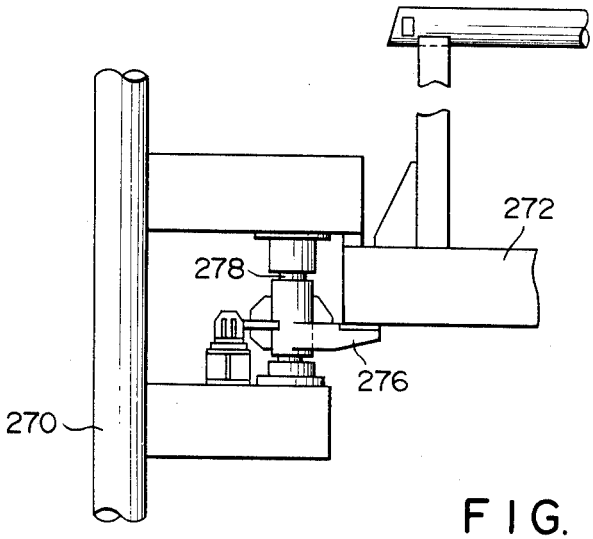
FIG. 32

CLOSED-LOOP AMUSEMENT RIDE SYSTEM

BACKGROUND OF THE INVENTION

The present invention relates to closed-loop amusement ride systems, such as roller coasters, installed in amusement parks and the like.

Conventional ride systems of this type comprise a pair of rails, extending parallelly at a fixed distance from each other, and a passenger car traveling on the rails. The rails are curved into various shapes, so that the car can, for example, ascend, descend, or roll, tracing the curved configuration of the rails.

Amusement ride systems have recently been developed, which are provided with a loop portion extending vertically, in the middle of the amusement ride. In these systems, the car makes a somersault while it runs past the loop portion. Thus, passengers in the car can experience the same thrill as may be obtained during an airplane's looping the loop, among other aerial acrobatics.

In the prior art ride systems, however, the car travels on the rails with the aid of a plurality of wheels, on its bottom surface. Therefore, the car cannot run like a spinning airplane.

Thus, it would be extremely thrilling for passengers to experience a simulated spin in the car, without having an actual ride in an airplane.

SUMMARY OF THE INVENTION

The object of the present invention is to provide a closed-loop amusement ride system, in which a passenger car can run with a feel similar to that obtained when an airplane is spinning.

The above object of the invention is achieved by an amusement ride system, which comprises rail means including a central axis, a plurality of rails arranged around the central axis while being separated from one another an equal distance, the rails being twisted around the central axis while maintaining the equal distance, in the middle of the longitudinal length of the rail means, thus forming at least one twist region; and a car capable of traveling, with passengers therein, on the rails, the car including a plurality of wheel units on each side portion thereof, along the rails, the wheel units each having a set of wheels, in rolling contact with the rail, so as to hold the rail therebetween.

According to the amusement ride system described above, the car travels on the rails with the aid of the wheel units. When the car runs past the twist region, it is rotated in accordance with the twist or torsion of the rails at the twist region. More specifically, the rails at the twist region are twisted around the central axis between them so that the car travels while rotating around a central axis. In other words, the car revolves on its axis when it runs past the twist region, thereby producing the same effect as the acrobatic spinning in an aircraft. Thus, passengers in the car can easily experience the same thrill as from a spin of aircraft without having an actual ride in an airplane.

If the rails are suitably curved for various configurations, moreover, the can also enjoy conventional acrobatic runs, such as nose diving, looping, etc.

Other features and advantages of the present invention will be apparent in the following detailed description of illustrative embodiments thereof, which is to be read in connection with the accompanying drawings.

BRIEF DESCRIPTION OF THE DRAWINGS

FIG. 31 is a side view of a delivery unit;

FIG. 32 is an enlarged view of a support claw of the delivery unit;

DETAILED DESCRIPTION OF THE PREFERRED EMBODIMENTS

Figure 1:
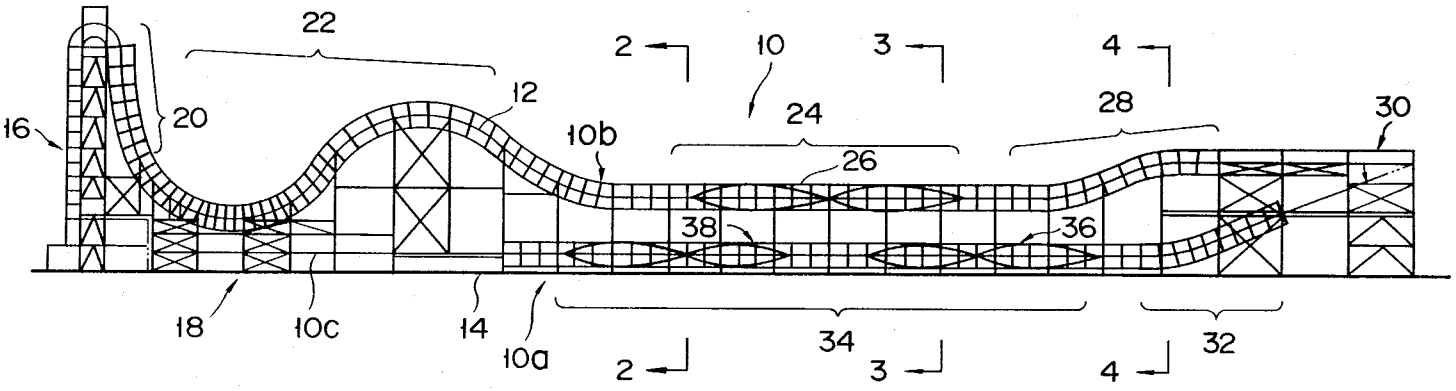
FIG. 1 is a schematic view showing an outline of an amusement ride system according to a first embodiment of the present invention.

Referring now to FIG. 1, there is shown an outline of a closed-loop amusement-ride system according to a first embodiment of the present invention. This system comprises tubular path 10, in the form of a substantially closed loop. Path 10 includes a pair of rails 12 extended at a fixed distance from each other. As seen from FIGS. 1 to 4, path 10 is formed of lower path section 10*a* located close to the ground, and upper path section 10*b* right over the lower path section.

On upper path section 10*b*, a passenger car (described in detail later) is driven to the right from the left end of the system, as in FIG. 1. When driven to the right end of section 10*b*, the car can be transferred therefrom to lower path section 10*a*, and then driven to the left from the right end of the system.

Disposed in the middle of lower path section 10*a* is platform 14, which facilitates passengers' getting in and out of the car. Lift mechanism 16, used to pull up the car, is provided on the left side of platform 14. The lift mechanism will be described, in detail, later. Travel guide unit 18, having coupling path 10*c* resembling tubular path 10, is arranged between mechanism 16 and platform 14. Thus, the car is delivered from platform 14 to mechanism 16, via guide unit 18.

Lift mechanism 16 pulls the passenger car up, and delivers it to the left end portion of upper path section 10*b*, where the car reaches its highest position. As shown in FIG. 1, section 10*b* includes drop portion 20, extending substantially vertically from the left end of section 10*b* which is connected to the upper end of mechanism 16. Drop portion 20 is connected to horizontal portion 24 through transitive portion 22. At portion 22, paired rails 12 are curved in a clothoid, extending from the lower part of drop portion 20, and are then curved upward and connected to horizontal portion 24.

Figure 5:
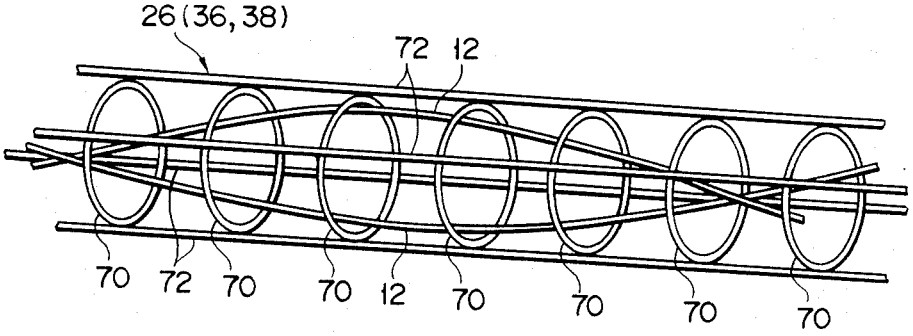
FIG. 5 is a perspective view showing part of a tubular path.

Twist region 26 is located in the middle of horizontal portion 24. At region 26, as seen from FIGS. 2, 3 and 5, rails 12 are twisted around center point O between them. In this first embodiment, the rails, at region 26, are twisted in a manner such that the car, running on the rails, makes a turn in one direction. At the starting and terminal ends of the twist region, however, rails 12 are twisted only gently, to avoid a drastic torsion.

Also, upper path section 10*b* includes incline portion 28, which is located next to horizontal portion 24. At portion 28, the passenger car, running from left to right of FIG. 1, in portion 24, is decelerated.

Delivery station 30 is disposed at the right end portion of upper path section 10*b*, whereby the car is transferred from section 10*b* to lower path section 10*a*. A specific arrangement of the delivery station will be described later.

Corresponding to upper path section 10*b*, lower path section 10*a* includes slant portion 32, continuous with delivery portion 30, and horizontal portion 34 located between portion 32 and platform 14. Paired rails 12 are twisted at portion 34, thus forming continuous twist regions 36 and 38, which are similar to twist region 26. Accordingly, if the car passes through both regions 36 and 38, then it makes two turns.

Figure 6:
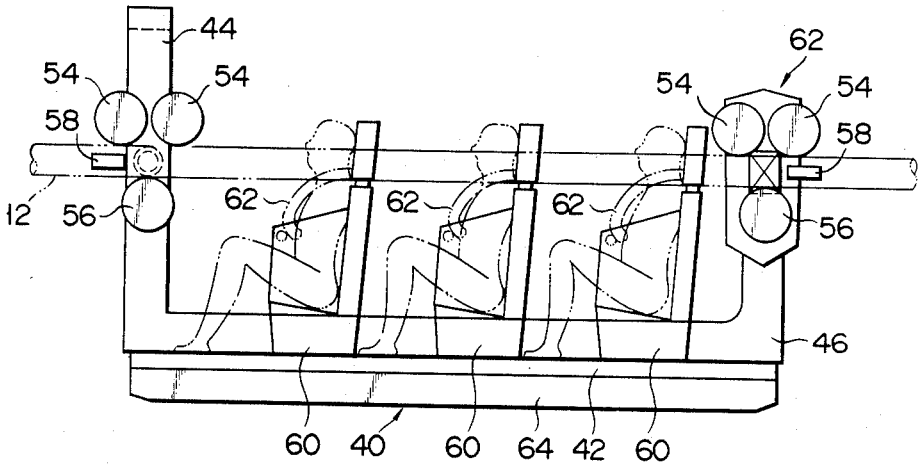
FIG. 6 is a schematic side view of a passenger car.
Figure 7:
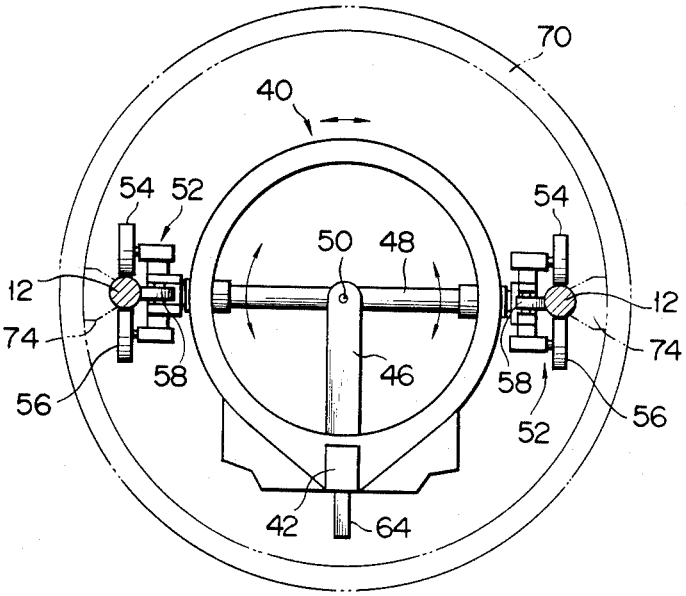
FIG. 7 is a schematic front view of the car.
Figure 8:
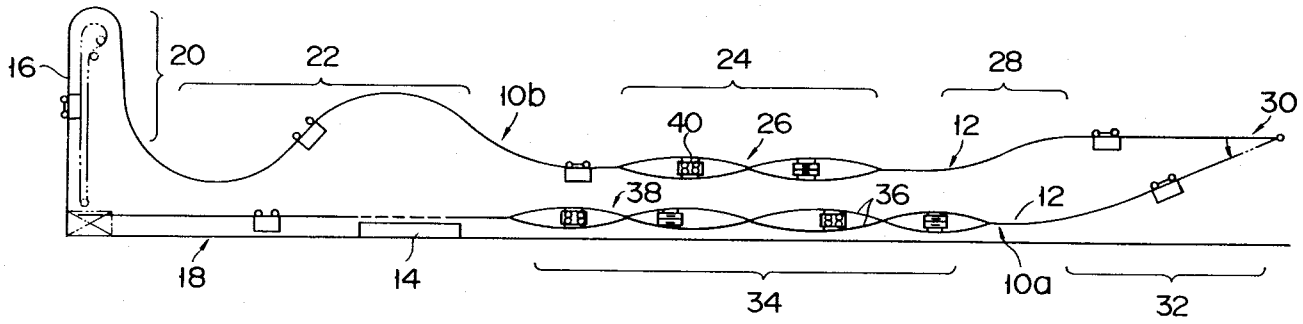
FIGS. 8 to 12 are schematic views for illustrating the way the car travels.
Figure 9:
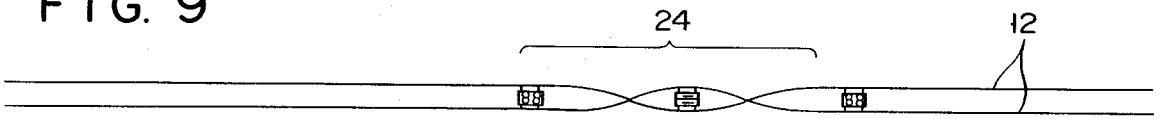
Figure 10:
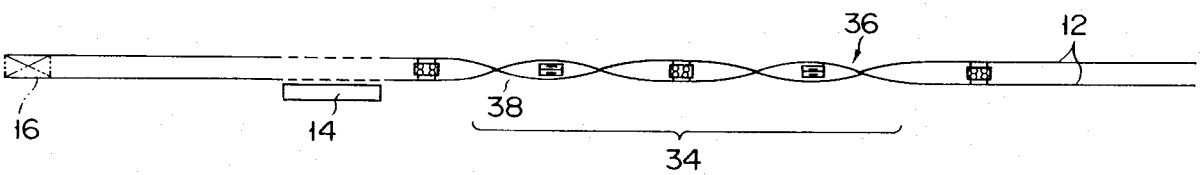
Figure 11:
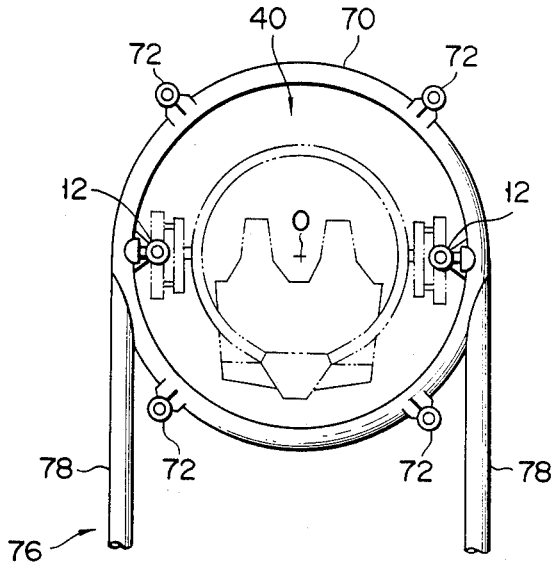
Figure 12:
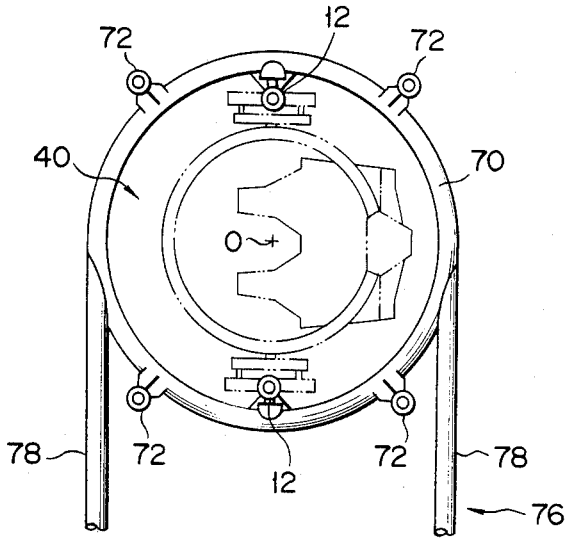

Referring now to FIGS. 6 and 7, passenger car 40, adapted to travel along tubular path 10, will be described in detail. The car, which is interposed between paired rails 12 of path 10, has main frame 42 extending along path 10. Ring-shaped front frame 44 is coupled to the front or left end (FIG. 6) of frame 42, extending vertically upward. Also, upwardly extending rear post 46 protrudes integrally from the rear end of frame 40. Cross frame 48, extending across rails 12, is connected to post 46 by means of shaft 50. Thus, frame 48 is rotatable around shaft 50, as indicated by arrows in FIG. 7. Here it is to be noted that shaft 50 is located on the axis of ring-shaped front frame 44, that is, on a center line between rails 12.

A pair of front wheel units 52 are attached individually to two opposite sides of front frame 44, diametrically facing each other, as shown in FIG. 7. Each unit 52 includes a pair of first wheels 54, second wheel 56, and third wheel 58. The first wheels, which are spaced along their corresponding rail 12 of tubular path 10, are in rolling contact with the rail, engaging it downwardly, as in FIGS. 6 and 7. The second wheel upwardly engages the rail, for rolling contact therewith, thus holding the rail, in cooperation with the first wheels. As seen from FIG. 7, the third wheel is in rolling contact with the inside of the rail.

Further, a pair of rear wheel units 62 are attached individually to two opposite ends of cross frame 48. Since each of units 62 has the same construction as each front wheel unit 52, like reference numerals are used to designate corresponding wheels of the front and rear wheel units. Wheel units 52 and 62 are rotatably mounted on car 40, so as to be able to run on paired rails 12, exactly following the curvature of the rails.

Constructed in this manner, passenger car 40 is attached to paired rails 12 of tubular path 10, so as to hang in midair, with the rails held between the individual wheels of front and rear wheel units 52 and 62. Thus, car 40 can travel along rails 12 by means of the wheels of the wheel units.

When passenger car 40, which travels along rails 12, comes to twist region 26, 36 or 38 of tubular path 10, it is rotated, as indicated by the arrows of FIG. 7, following the twist of rails 12 at the twist region. In this case, the center of rotation of car 40 is located on center point O between rails 12.

Referring now to FIG. 6, car 40 is provided with a plurality of seats 60, arranged in the longitudinal direction of the car. Each seat 60 is fitted with safety belt 62 for securing a passenger's body to the seat. As shown in FIGS. 6 and 7, brake plate 64, extending in the longitudinal direction of car 40, is attached to the bottom surface of the car. When car 40 comes to platform 14 (FIG. 1), plate 64 is held between brake pads of a braking system (not shown), which is mounted on the platform. Thus, the car can be braked and stopped at a predetermined position on platform 14.

Paired rails 12, which are used to guide car 40, are each formed of a pipe member. Referring again to FIGS. 2 to 5, a specific configuration of tubular path 10, including rails 12, will be described. Path 10 includes a number of ring-shaped ribs 70, which are coupled to rails 12 so as to surround them. The ribs are arranged at regular intervals along the rails. Like rails 12, ribs 70 are each formed of a pipe member. The center of each ring-shaped rib 70 is coincident with center point O between rails 12. In other words, rails 12 are spaced at a fixed distance, in the diametrical direction of each rib 70. Tubular path 10 further includes a plurality of beam members 72, e.g., four in number, which extend in the longitudinal direction of rails 12, and are coupled to ribs 70 from outside, in the radial direction of the ribs. Members 72 are arranged at regular intervals, in the circumferential direction of ribs 70. Like the ribs, the beam members are each formed of a pipe member. Also, members 72 are curved, thus defining the curved configuration of path 10. As path 10 is formed of ribs 70 and beam members 72, a space, for the travel of car 40, is defined inside path 10. Rails 12 and members 72 are fixed to ribs 70 by means of a number of fitting members 74 (not shown in FIG. 5).

Figure 2:
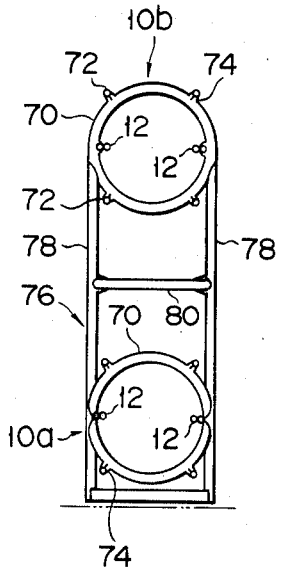
FIG. 2 is a sectional view taken along line 2—2 of FIG. 1.
Figure 3:
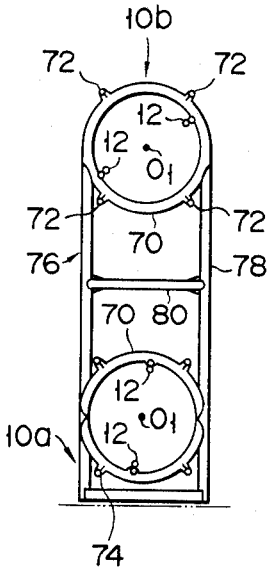
FIG. 3 is a sectional view taken along line 3—3 of FIG. 1.
Figure 4:
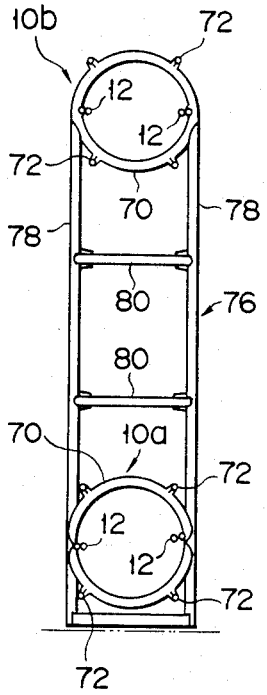
FIG. 4 is a sectional view taken along line 4—4 of FIG. 1.

As seen from FIGS. 2 to 4, tubular path 10, with the aforementioned construction, is supported by a number of support frames 76. Frames 76 support both lower and upper path sections 10*a* and 10*b*, which constitute path 10. Each support frame includes, for example, a pair of upright posts 78, which support ribs 70 of path sections 10*a* and 10*b*, and reinforcing member or members 80 connecting the posts.

Referring now to FIGS. 8 to 12, there will be described the way passenger car 40 travels within tubular path 10. Let it be supposed that car 40 is first located on platform 14. In this case, car 40 has its back toward lift mechanism 16. In this state, passengers get in car 40, stepping off leaving platform 14, and then taking the seats 60 in the car.

After a safety check, car 40 is moved toward lift mechanism 16 by travel guide unit 18. Mechanism 16 changes the posture of car 40, driven from platform 14, so that the front of car 40 is upward. Then, the lift mechanism forces the car up, thus leading it to the left end (FIG. 8) of upper path section 10*b* of tubular path 10.

Thereafter, passenger car 40, in a forward-directed position, drops along drop portion 20 of upper path section 10*b*, by gravity. At portion 20, rails 12 are substantially vertical, having a tilt of zero to 20 degrees, so that car 40 nose-dives, with its front forward. This enables the passengers in car 40 to enjoy a thrill, similar to one obtained during an airplane nose dive.

After reaching the lower part of drop portion 20, car 40 travels past transitive portion 22, and then gets to horizontal portion 24. At portion 22, which lies next to portion 20, rails 12 are curved in a clothoid. While car 40 is moving from drop portion 20 to transitive portion 22, therefore, the impact of the motion on the passengers is eased. After entering portion 22, car 40 reaches horizontal portion 24 via an upwardly curved part of the transitive portion. At portion 24, car 40 is driven by the force of inertia, produced when the car runs down the curved part of transitive portion 22. As car 40 moves past twist region 26, in the middle of horizontal portion 24, it makes a turn in a direction, following the twist of rails 12 at region 26, as seen from FIGS. 11 and 12. At portion 26, as mentioned before, rails 12 are twisted around center point O between them, or the center of each ring-shaped rib 70. Therefore, car 40 makes one revolution around its axis. Such rotation of car 40 causes the passengers to feel a simulated spin of aircraft.

After running past horizontal portion 24, car 40 reaches incline portion 28, where it is decelerated. Thereafter, the car moves from portion 28 to delivery portion 30, where it is stopped temporarily.

At delivery portion 30, car 40 is transferred from upper path section 10*b* to lower path section 10*a*. At this time, the car enters section 10*a*, with its back forward. In the lower path section, which includes slant portion 32 and horizontal portion 34, continuous with delivery portion 30, successively, car 40 enters portion 34, after being accelerated while running down the slant portion. Since horizontal portion 34 includes twist regions 36 and 38, similar to twist region 26, car 40 spins for two revolutions, while passing through portion 34. In this case, car 40 is running with its back forward, so that it is in a backward-directed position when it spins. Aircraft cannot make such a backward-directed spin. Thus, the passengers on car 40 can enjoy a very thrilling experience. Preferably, the rotating direction of car 40, at twist regions 36 and 38 of lower path section 10*a*, is opposite to that at twist region 26 of upper path section 10*b*.

After passing through horizontal portion 34 of lower path section 10*a*, in this manner, car 40 reaches platform 14, where it is stopped. Thereupon, the passengers get off car 40 and stand on platform 14, while another group of passengers get on the car. Thereafter, car 40 travels repeatedly along tubular path 10, in the manner as aforesaid. Since drop portion 20 and twist regions 26, 36 and 38 are provided in tubular path 10, the passengers in car 40 can enjoy thrills, resembling those obtained from aerial acrobatics, such as nose diving and spinning. Besides, they can enjoy such an adventure as backward spinning, which cannot be experienced even in a stunt-flying airplane.

Rails 12, which enable an acrobatic travel of passenger car 40, are supported by numerous ribs 70, so that it is easy to make the distance between the rails uniform. Since ribs 70 are ring-shaped, moreover, the uniform distance can be maintained by attaching rails 12, individually, to two diametrically opposite portions of the inner peripheral surface of each rib 70.

At each twist region of tubular path 10, rails 12 are twisted as aforesaid. Also in this case, the distance between rails 12 can easily be kept uniform by the use of ribs 70, despite the torsion of the rails. Thus, as is evident from FIGS. 11 and 12, the uniform distance between the rails can be maintained by only shifting the mounting positions of the rails on ribs 70, in the circumferential direction of the ribs, in accordance with the twist of the rails.

Having uniform rigidity in its radial direction, each ring-shaped rib 70 can securely support rails 12, no matter how much the rails are twisted. Thus, the degree of torsion of rails 12 can be set freely.

Passenger car 40, running in tubular path 10, rotates around the center of each rib 70, or on its own axis, when it moves past the twist regions. Accordingly, the car cannot be subjected to an excessive centrifugal force, thus enjoying improved running stability.

In the first embodiment described above, tubular path 10 has a double-path structure, including lower and upper path sections 10*a* and 10*b*. When installing the system of the present invention in an amusement park or the like, therefore, the system only requires a relatively narrow space.

Specific arrangements of lift mechanism 16 and delivery station 30 will now be described in detail.

Figure 13:
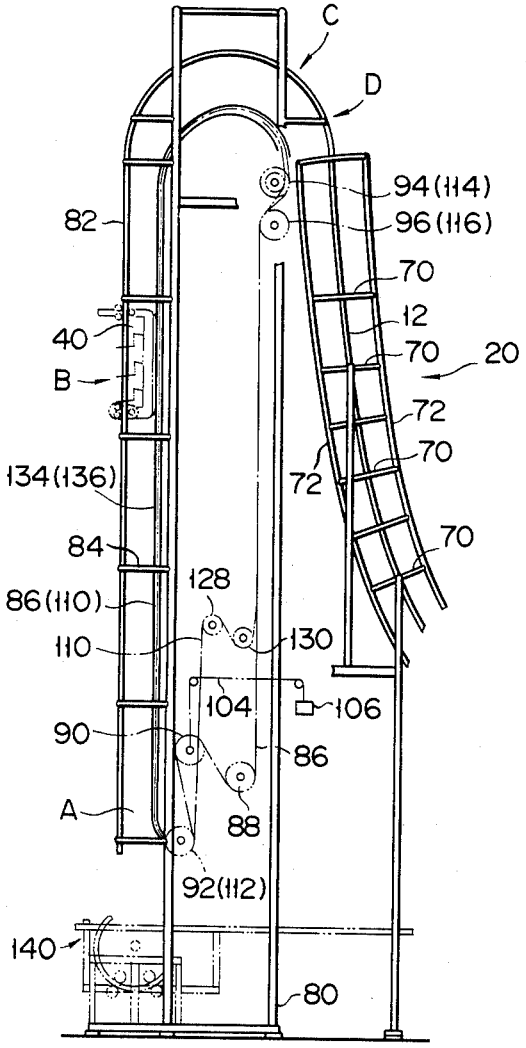
FIG. 13 is a schematic side view of a lift mechanism.
Figure 14:
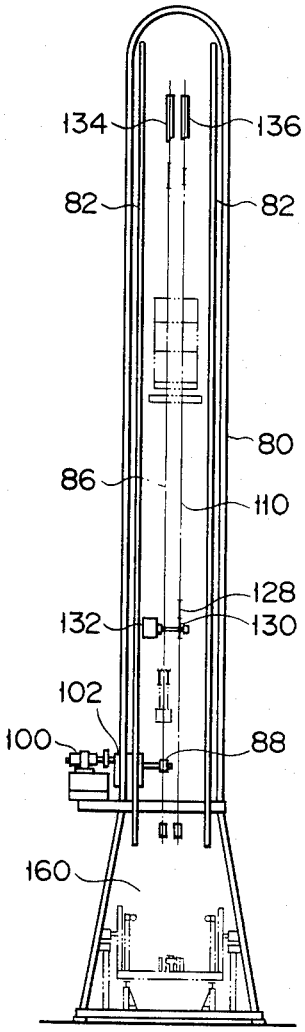
FIG. 14 is a schematic front view of the lift mechanism.

Referring now to FIGS. 13 and 14, there is shown an outline of lift mechanism 16. Mechanism 16 includes support post 80, which extends vertically. On the left of post 80, as in FIG. 13, a pair of pull-up rails 82 are supported on post 80, extending parallel thereto. The lower end of each rail 82 is located at a predetermined distance from the ground, while its upper end is curved upward, and then connected to its corresponding rail 12 of upper path section 10*b*. Thus, rails 82 are spaced at a distance equal to that between rails 12. In FIG. 13, numeral 84 designates mounting members for pull-up rails 82.

Support post 80 is provided with endless pull-up chain 86, which extends along paired pull-up rails 82. Chain 86 is passed, in an endless manner, around driving sprocket 88 (FIG. 14), tension sprocket 90, and driven sprockets 92, 94 and 96. Sprocket 88 is connected to main motor 100 by means of speed reducer 102. Sprocket 90 is connected to one end of suspension wire 104, the other end of which is connected to balance weight 106. Thus, as seen from FIG. 13, tension sprocket 90 can give the pull-up chain a predetermined tension, which depends on the weight of the load 106.

Support post 80 is provided with endless emergency chain 110, besides pull-up chain 86. Like chain 86, emergency chain 110 extends along pull-up rails 86. Chain 110 is passed, in an endless manner, around driven sprockets 112, 114 and 116, coaxial with driven sprockets 92, 94 and 96, respectively; driven sprocket 128 for exclusive use with chain 110; and driving sprocket 130. Sprocket 130 is connected to motor 132, with a speed reducer, as shown in FIG. 14. Chains 86 and 110, which extend parallel to each other, as shown in FIG. 14, are guided in travel, by guide means 134 and 136 (shown only schematically in FIG. 14), respectively.

Passenger car 40 engages pull-up chain 86, and as chain 86 is driven, the car is pulled up along pull-up rails 82. Before explaining the engagement between car 40 and chain 86, posture changing mechanism 140 for the car will be described. As shown schematically in FIGS. 13 and 14, mechanism 140 is located under pull-up rails 82.

Figure 15:
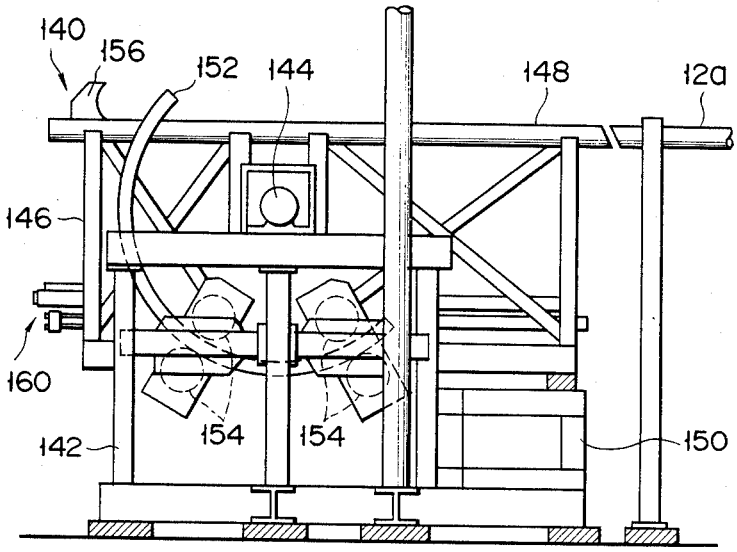
FIG. 15 is a side view of a posture changing mechanism for the car.
Figure 16:
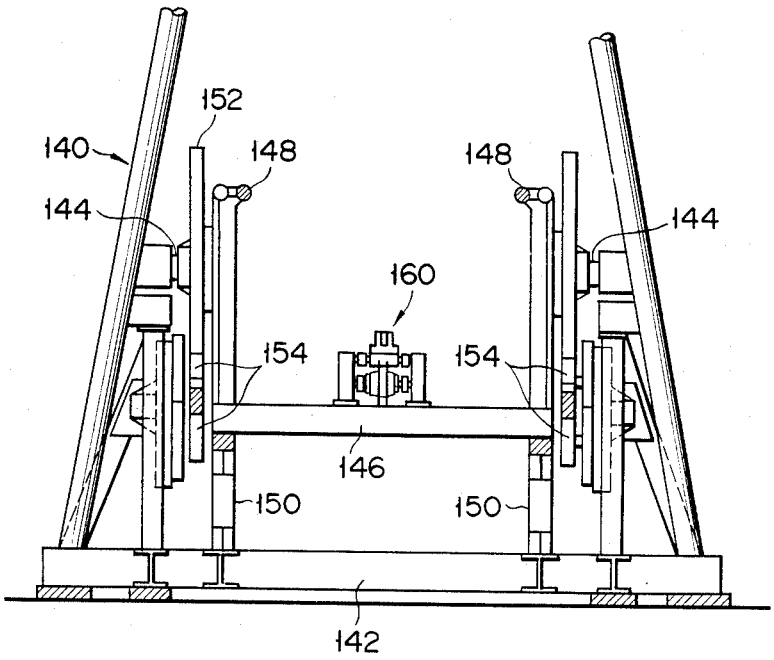
FIG. 16 is a front view of the posture changing mechanism.

Posture changing mechanism 140 is best seen from FIGS. 15 and 16. As shown in FIG. 15, mechanism 140 includes base frame 142, in which bucket 146 for car 40 is rotatably supported by means of a pair of shafts 144. Bucket 146 is shaped like a box, open at the top and at the side facing travel guide unit 18, as seen from FIG. 15. As shown in FIG. 16, a pair of auxiliary rails 148 are attached to bucket 146. When bucket 146 is in the position shown in FIG. 15, rails 148 are connected, with a predetermined gap, to a pair of coupling rails 12*a* (which are connected to rails 12 of lower path section 10*a* of tubular path 10) of coupling path 10*c* in guide unit 18. Accordingly, car 40, guided in a backward-directed position, from platform 14 by rails 12*a*, can enter bucket 146, as its four wheel units transfer from rails 12*a* to auxiliary rails 148. In FIG. 15, numeral 150 designates a pair of stopper members, which serves to restrain bucket 146 from rotating, thus keeping it in a horizontal posture.

A pair of arcuate drive rails 152 are mounted on the outside of the opposite lateral faces of bucket 146, which extend along auxiliary rails 148. Two pairs of driving wheels 154 are arranged on base frame 142, so as to hold the drive rails between them. When wheels 154 are rotated by a drive source (not shown), rails 152 are rotated around paired shafts 144 of bucket 146. As a result, bucket 146 or passenger car 40 therein, is shifted to a position such that its front is turned up. In this state, car 40 tends to drop by gravity. To prevent such drop, a pair of stoppers 156 (FIG. 15) are mounted on bucket 146.

As shown in FIG. 16, moreover, push-up mechanism 160 is provided at the bottom of bucket 146. It serves to push up car 40 in bucket 146 when the bucket is in its upright position.

Figure 17:
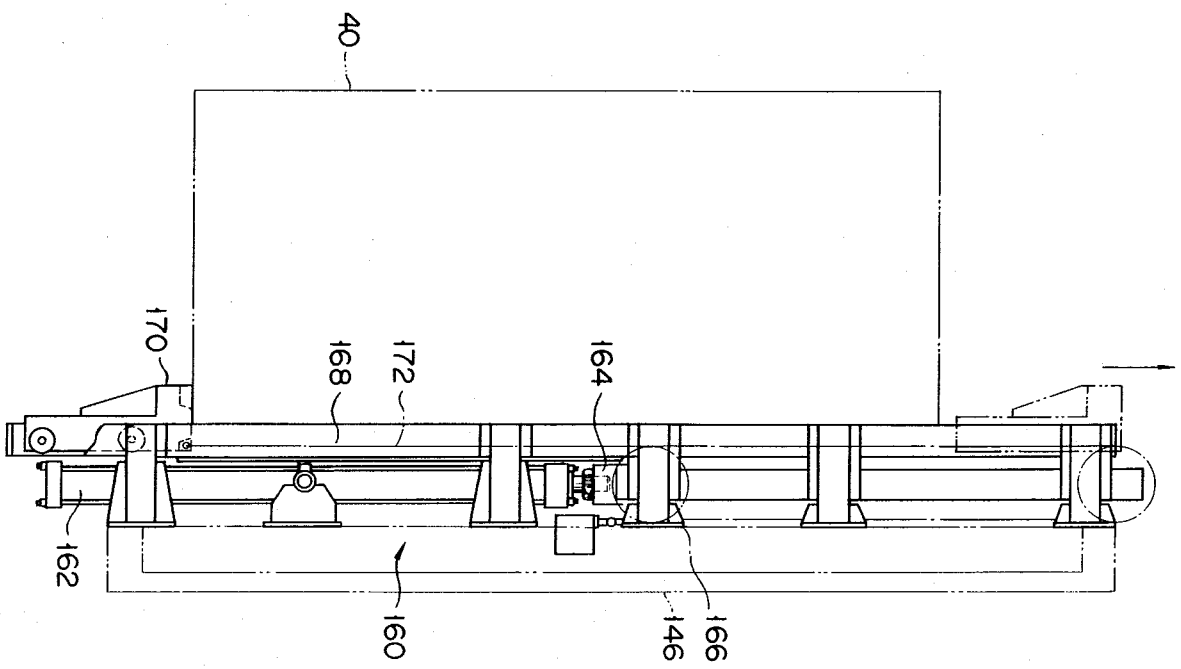
FIG. 17 is a schematic side view of a push-up mechanism.

Push-up mechanism 160 is best shown in FIG. 17. In FIG. 17, bucket 146 stands upright. Mechanism 160 includes hydraulic cylinder 162. Sprocket 166 is rotatably attached to the distal end of piston rod 164 of cylinder 162. The push-up mechanism further includes guide rail 168, which extends along cylinder 162. Push-up member 170, used to push up car 40, is disposed in rail 168 so as to be movable along the rail. One end of push-up chain 172 is coupled to member 170. The other end of chain 172 is fixed beside the projecting end portion of the piston rod of cylinder 162, by means of sprocket 166.

Thus, according to push-up mechanism 160, when bucket 146 is in its upright position, with passenger car 40 therein, push-up member 170 can be moved along guide rail 168, with the aid of sprocket 166 and push-up chain 172, to engage car 40, as shown in FIG. 17, by extending piston rod 164 of hydraulic cylinder 162. If the piston rod is extended further, with member 170 engaging car 40 in this manner, therefore, car 40 can be moved upward or toward pull-up rails 82, as member 170 moves.

When bucket 146 is in the upright position, auxiliary rails 148 of bucket 146 are connected to pull-up rails 82, with a predetermined gap between them. Although this connection is not shown directly, it will be supposed from FIG. 15, which shows the relative positions of rails 148 and coupling rails 12*a*. Thus, when car 40 in bucket 146 is pushed up in the aforesaid manner, by push-up mechanism 160, wheel units 52 and 62 of the car move from auxiliary rails 148 of bucket 146 to pull-up rails 82, so that car 40 is transferred from bucket 146 to rails 82.

Figure 18:
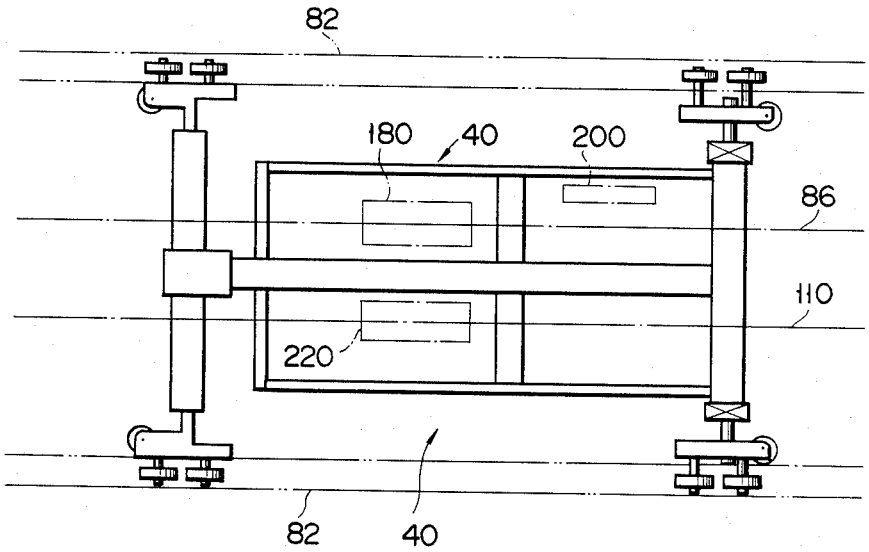
FIGS. 18 and 19 are schematic views showing the relative positions of a hook mechanism of the car and a pull-up chain.
Figure 19:
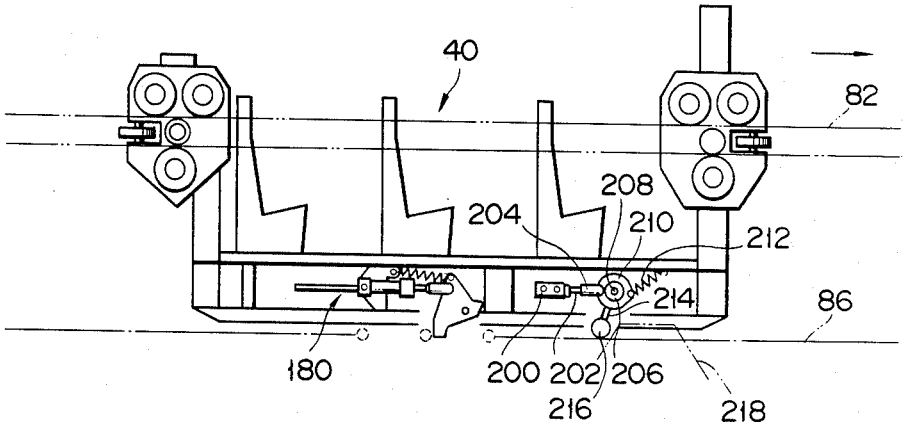

Pulled up to pull-up rails 82, in this manner, passenger car 40 can further move upward along the rails 82. In doing this, car 40 ascends as pull-up chain 86 runs. Hook mechanism 180, adapted to engage chain 86, is disposed on the bottom surface of car 40. FIG. 18 shows the mounting position of mechanism 180 on car 40, while FIG. 19 schematically shows the construction of the hook mechanism. Referring now to FIGS. 20 to 23, there is best shown the configuration of hook mechanism 180. Mechanism 180 includes hook 184, which is rockably mounted on the bottom wall of car 40 by means of pin 182. Hook 184 has hook claw 186 which, projecting from the bottom surface of car 40, can engage pin 86*a* of pull-up chain 86. Also, hook 184 is formed with extending portion 188, which extends in the opposite direction to claw 186. Tension coil spring 190 is stretched between portion 188 and car 40. Spring 190 continually urges hook 184 to rotate in the counterclockwise direction of FIG. 20, around pin 182, so that hook claw 186 engages pin 86*a* of chain 86. Hook 184 is further formed with abutting portion 192, which projects upward, as in FIG. 20. When hook 184 is rocked by spring 190, portion 192 abuts against stopper 194 on car 40, as shown in FIG. 21.

Hook mechanism 180 further includes hydraulic cylinder 196 which is fixed to car 40. Cylinder 196 has a pair of piston rods, which extend opposite to each other, along the axis of the cylinder. Piston rod 198, out of the two rods, is coupled to the distal end of extending portion 188 of hook 184.

The inside of hydraulic cylinder 196 is divided into two pressure chambers by a piston (not shown). As shown in FIGS. 18 and 19, these pressure chambers can be connected by means of directional control valve 200, which is attached to car 40. As shown in FIG. 19, valve 200 has operating rod 202 for its operation. Cam follower 204 is attached to the end of rod 202. It is in sliding contact with cam 206, which is rotatably mounted on car 40 by means of pin 208. Also, disk 210 is mounted on pin 208. It is urged to rock in one direction, by compression coil spring 212. Roller 216, projecting from the bottom surface of car 40, is attached to disk 210 by means of lever 214. As shown in FIG. 19, roller 216 can engage a plurality of engaging members 218, which are arranged in predetermined positions, along pull-up chain 86. Each engaging member 218, as shown in FIG. 19, is cone-shaped, projecting toward car 40. Thus, as car 40 travels, roller 216 can engage and then get over engaging members 218. When roller 206 clears one of the engaging members, directional control valve 200 is operated through the medium of cam 206, cam follower 204, and operating rod 202. The specific operation of valve 200 will be understood from the following description.

Figure 20:
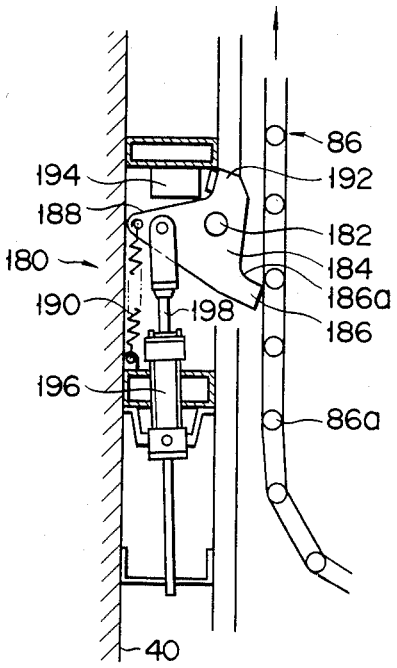
FIGS. 20 to 23 are schematic views for illustrating the operation of the hook mechanism.
Figure 21:
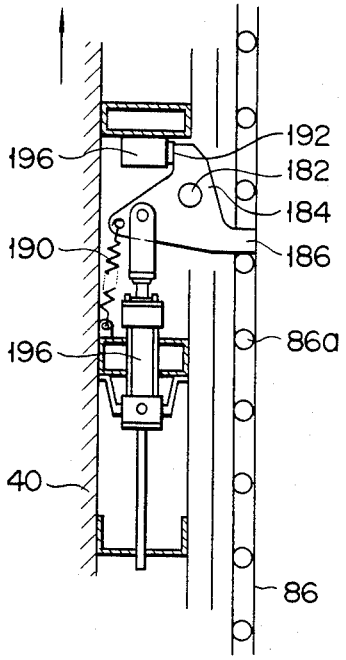
Figure 22:
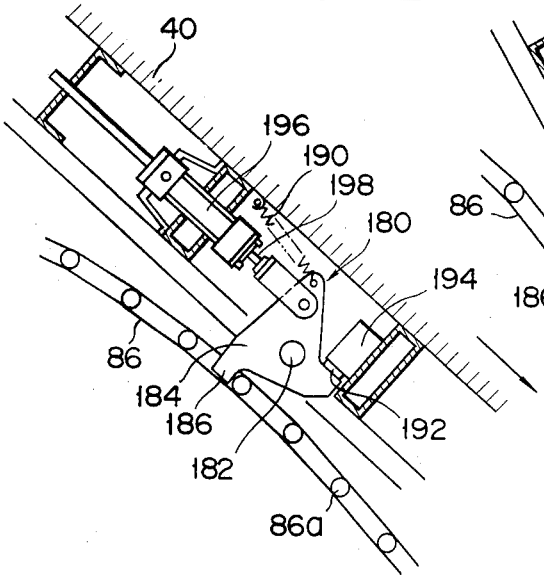
Figure 23:
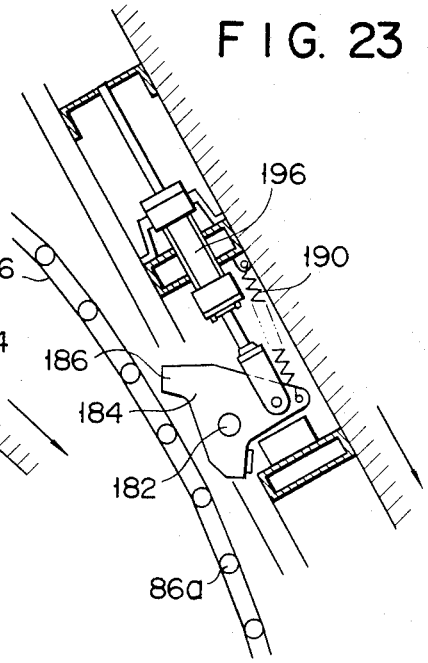

In the state shown FIG. 20, car 40 is on pull-up rails 82, just after having being transferred from auxiliary rails 148 of bucket 146, by push-up mechanism 160. In other words, the car is located in position A of FIG. 13. At this time, hook mechanism 180 of car 40 is in the state of FIG. 20, in which hook claw 186 of hook 184 is not yet in full engagement with any of pins **86*a* of pull-up chain 86. In this case, the two pressure chambers of hydraulic cylinder 196 connect with each other by means of directional control valve 200. Here it is to be noted that the car push-up speed of push-up mechanism 160 is higher than the running speed of the pull-up chain. Thus, if car 40 is pushed up by mechanism 160, hook 184 of hook mechanism 180 can rock around pin 182, against the urging force of tension coil spring 190, so that hook claw 186 escapes from pin 86*a* of chain 86. To facilitate such escape of claw 186, that lateral face of the claw on the upper side of FIG. 20 is curved downward, thus forming curved surface 186*a***.

When car 40 reaches the highest position it can attain, pushed by push-up mechanism 160, it ceases to be pushed up. In this case, hook 184 or hook claw 186 of hook mechanism 180 is rocked counterclockwise by the urging force of tension coil spring 190. As a result, claw 186 of hook 184 enters the space between each two adjacent pins **86*a* of pull-up chain 86, while abutting portion 192 abuts against stopper 194 of car 40. Thus, as chain 86 travels, in such a state, pin 86*a* of chain fully engages claw 186, as shown in FIG. 21, so that car 40 moves upward, thereafter. When claw 186 reaches the position shown in FIG. 21, directional control valve 200 is switched, so that the two pressure chambers of hydraulic cylinder 196 are disconnected. The relative positions of hook mechanism 180 and chain 86, shown in FIG. 21, correspond to position B of FIG. 13. This situation is maintained while car 40 is moving from point A to C of FIG. 13**.

When car 40 travels past point C, where pull-up rails 82 are curved, forming the peak of the path, it is urged by gravity to drop at a speed higher than the running speed of pull-up chain 86. In this case, however, hook claw 186 of hook mechanism 180 is kept projecting from the bottom surface of car 40. In contrast with the state shown in FIG. 21, curved surface **186*a* of claw 186 engages pin 86*a* of chain 86. Thus, when car 40 runs past the peak portion of rails 82, chain 86 can prevent car 40** from naturally dropping by gravity.

When car 40 reaches position D of FIG. 13, thereafter, directional control valve 200 is switched so that the pressure chambers of hydraulic cylinder 192 connect with each other. In cylinder 196, as seen from FIG. 22, piston rod 198 has so far been contracted. Accordingly, the pressure inside that pressure chamber of cylinder 196, on the opposite side to rod 198, is higher than that inside the other chamber. In this state, if valve 200 is switched, so as to make the pressure chambers communicate with each other, the piston rod of cylinder 196 is extended against the urging force of tension coil spring 190. As a result, hook claw 186 of hook mechanism 180 is rocked so as to escape from pin **86*a* of pull-up chain 86. Thus, claw 186 and chain 86 are disengaged from each other. At this point of time, car 40 can run down drop portion 20 of upper path section 10*b*, guided from pull-up rails 82 to rails 12 of tubular path 10**.

According to lift mechanism 16 for car 40, as described above, car 40 can be raised securely by means of pull-up chain 86. Moreover, when car 40 starts to drop naturally by gravity, after having run past the peak portion of pull-up rails 82, such natural drop can be prevented by securely maintaining the engagement between chain 86 and hook claw 186 of hook mechanism 180. Thus, the timing for the car to run down drop portion 20 of tubular path 10 can be determined by the switching timing of directional control valve 200.

Further, the engagement, between hook claw 186 of hook mechanism 180 and pin **86*a* of pull-up chain 86, can be released in an instant, by operating hydraulic cylinder 196. Therefore, claw 186 can be prevented from touching pin 86*a* in an undesired manner, while car 40 is dropping naturally. Thus, claw 186** can be protected against excessive load, and hence, against wear and distortion.

Lift mechanism 16 is provided with safety device 220. If pull-up chain 86 should be disengaged from hook mechanism 180, during the pull-up process, device 220, in cooperation with emergency chain 110, would prevent car 40 from dropping by gravity, that is, from running backward. The safety device is mounted on the car. FIG. 18 schematically shows the mounting position.

Figure 24:
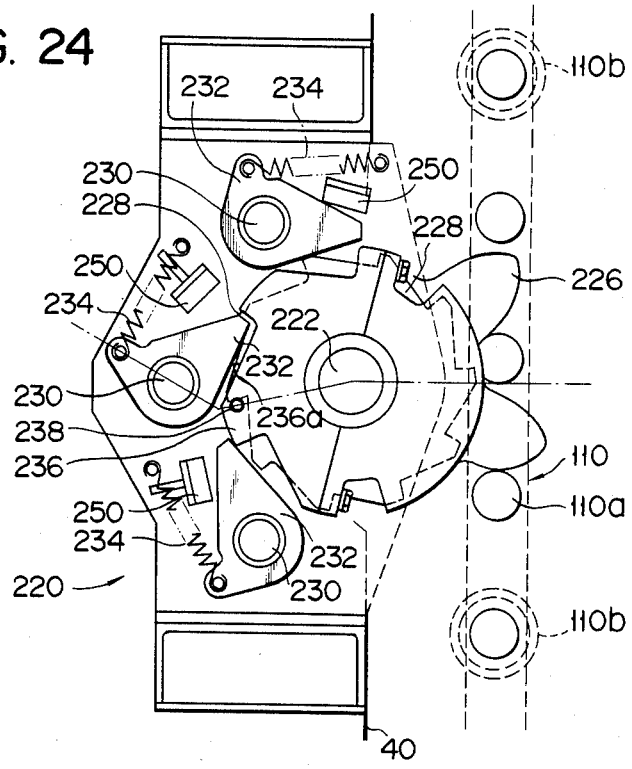
FIG. 24 is a side view showing part of a safety device.
Figure 25:
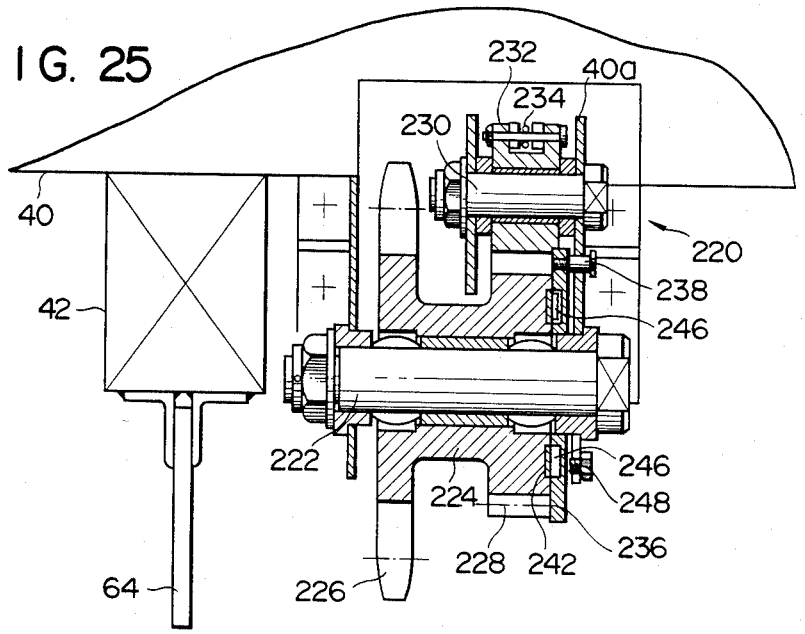
FIG. 25 is a sectional view taken along line 25—25 of FIG. 24.

Safety device 220 is best shown in FIGS. 24 and 25. Prior to device 220, emergency chain 110 will be described. Chain 110 include links, pins connecting the links, and rollers **110*a*, which are rotatably mounted on the pins by means of bushings, individually. As seen from FIG. 24, the width of the links of chain 110 is a little greater than the outside diameter of rollers 110*a*. Further, some of the pins of chain 110 are fitted with side rollers 110*b*, which are distributed with every predetermined number of links. Rollers 110*b* are guided in guide means 136. Here it is to be noted that emergency chain 110, unlike pull-up chain 86**, is kept from running, normally.

Safety device 220 includes safety wheel 224, which is rotatably mounted on passenger car 40 by means of shaft 222. Wheel 224 is formed of sprocket 226 capable of engaging emergency chain 110, and ratchet wheel 228, coupled integrally. As seen from FIG. 24, both sprocket 226 and wheel 228 project from the bottom surface of car 40. Accordingly, when car 40 is pushed up by push-up mechanism 160, and raised up by pull-up chain 86, in the aforesaid manner, sprocket 226 of safety device 220 engages emergency chain 110, as shown in FIG. 24.

Three ratchet detents 232, which are rotatably mounted on car 40 by means of detent shafts 230, individually, surround the outer-half region of ratchet wheel 228. Tension coil spring 234 is anchored between each detent 232 and car 40. Springs 234 continually urge their corresponding detents 232 to rock in the direction to engage wheel 228. Thus, each detent 232 is urged to rock in the clockwise direction of FIG. 24, around its corresponding shaft 230.

Figure 26:
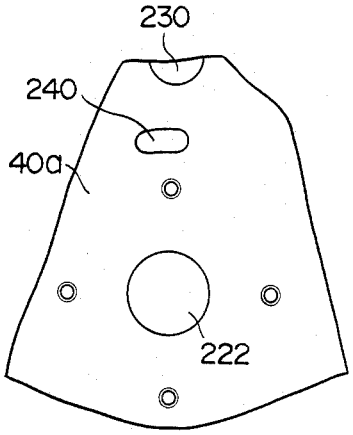
FIG. 26 is a side view showing part of a plate for supporting a sprocket of the safety device.
Figure 27:
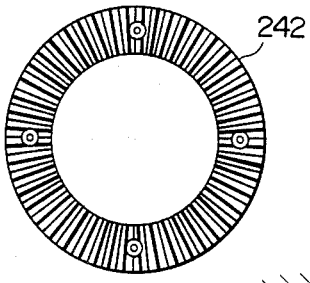
FIG. 27 is a side view of a ratchet ring.

Cam disk 236 is mounted on shaft 222 of ratchet wheel 228, so as to be rotatable independently of shaft 222. Disk 236, which is a little greater in diameter than wheel 228, is located on one end face of wheel 228, as shown in FIG. 25. As seen from FIG. 24, the semicircular peripheral surface of the cam disk, on the side of ratchet detents 232, is defined as cam face **236*a* which can engage the detents. Face 236*a* resembles the serrated peripheral edge of wheel 228, in shape. Stop pin 238 protrudes from the outer peripheral edge portion of disk 236. As shown in FIG. 26, pin 238 is passed through slot 240 in plate 40*a*, which is fixed to car 40. Slot 240 is shaped like an arc of a circle, around shaft 222 of ratchet wheel 228. Plate 40*a* serves also as a support plate, for shaft 222 and detent shafts 230. Thus, cam disk 236 can rotate through a predetermined rocking angle, which is determined by the length of slot 240**.

Figure 28:
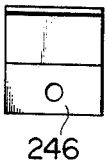
FIG. 28 is a front view of a spring detent.
Figure 29:
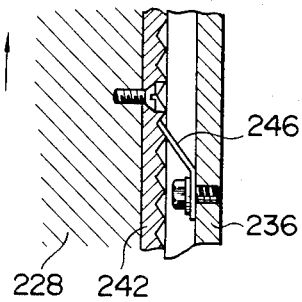
FIG. 29 is a sectional view showing an engagement between the ratchet ring and spring detent.

Ratchet ring 242 is disposed between cam disk 236 and ratchet wheel 228. Ring 242 is fixedly housed in annular groove 244, which is formed concentrically in the aforesaid end face of wheel 228. The toothed face of ring 242 is opposed to disk 236. Spring detent 246, formed of a leaf spring, as shown in FIGS. 28 and 29, is fixed to that surface of disk 236 which faces ring 242. The free end of detent 246 engages the toothed face of ring 242. If wheel 228 is rotated in the clockwise direction of FIG. 24, or in the direction indicated by an arrow in FIG. 29, the free end of detent 246 extends in the direction of the arrow, thus engaging the toothed face of ring 242. Plate **40*a* is fitted with a plurality of pressure screws 248, which press cam disk 236 toward ratchet ring 242. Only one of screws 248 is shown in FIG. 25**.

Figure 30:
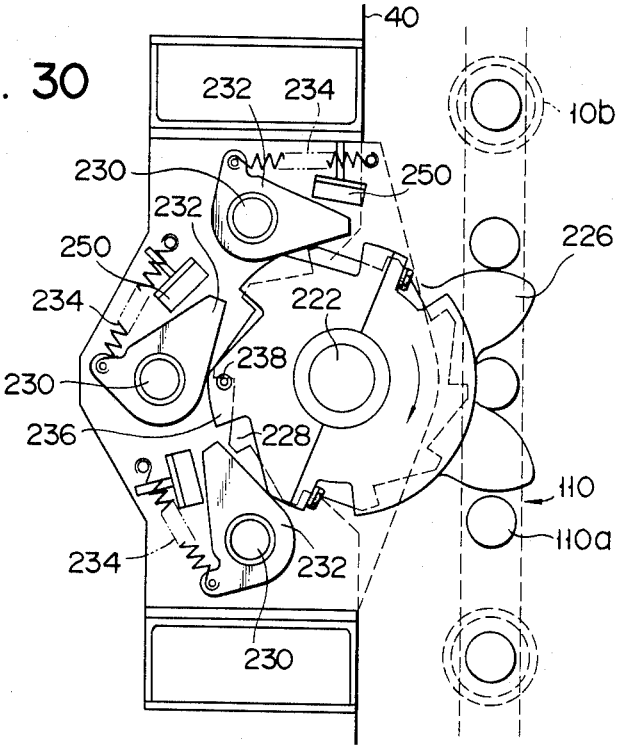
FIG. 30 is a side view, similar to FIG. 24, showing part of the safety device.

The operation of safety device 220 will now be described. While car 40 is normally ascending, as pull-up chain 86 runs, emergency chain 110 is kept from running. Accordingly, sprocket 226 of device 220, in engagement with chain 110, rotates in the clockwise direction, as indicated by an arrow in FIG. 30. When sprocket 226 rotates in this manner, ratchet wheel 228, integral with the sprocket, also rotates. At the same time, ratchet ring 242, which is fixed to wheel 228, rotates. In this case, cam disk 236 is pressed against ring 242, through the medium of spring detent 246, so that the disk, along with wheel 228 or sprocket 226, is rotated by a frictional force, produced between detent 246 and the toothed face of ring 242. As disk 236 rotates in this manner, three ratchet detents 232 rock against the urging force of their corresponding tension coil springs 234, thereby leaving the toothed face of wheel 228, as shown in FIG. 30. Thus, detents 232 are disengaged from ratchet wheel 228. Since disk 236 ceases to rock when stop pin 238 abuts against one end portion of slot 240 of plate **40*a*, detents 232 are kept disengaged from wheel 228, by the action of cam face 236*a* of the cam disk. In FIGS. 24 and 30, numeral 250 designates rubber plates for restricting the range of rotation of detents 232**.

Thus, while car 40 is normally ascending, as pullup chain 86 runs, ratchet detents 232 are kept off the toothed face of ratchet wheel 228, as aforesaid. Accordingly, detents 232 can be prevented from tapping against the toothed face of ratchet wheel 228, in rotation.

If hook claw 186 of hook mechanism 180 of car 40 should be disengaged from pin **86*a* of pull-up chain 86, thereby allowing the car to run backward, or drop naturally by gravity, sprocket 226 and ratchet wheel 228 would rotate in the counterclockwise direction of FIG. 30. Accordingly, ratchet ring 242, fixed to wheel 228, also rotates counterclockwise, whereupon cam disk 236 is rotated through the medium of spring detent 246. As a result, disk 236 reaches the rotational position shown in FIG. 24. In this position, at least one of ratchet detents 232 is rocked by the urging force of tension coil spring 234, without regard to the presence of disk 236. Thus, the ratchet detent engages the toothed face of ratchet wheel 228, as shown in FIG. 24. In the state shown in FIG. 24, wheel 228 or sprocket 226 cannot rotate any longer, so that car 40 is kept at a standstill, with respect to emergency chain 110. Thereafter, car 40 can be put back into bucket 146 of posture changing mechanism 140, by slowly driving chain 110 in the direction opposite to the running direction of pull-up chain 86**.

Referring now to FIGS. 31 and 32, there is shown delivery station 30, which is used to transfer passenger car 40 from upper path section **10*b* to lower path section 10*a* in tubular path 10. As shown in FIG. 31, station 30 is provided with base 270. Bucket 272, similar to bucket 146 of posture changing mechanism 140, is supported on base 270. Bucket 272 is located so as to be continuous with the end of path section 10*b*. That end portion of bucket 272 remote from section 10*b* is coupled to base 270 by means of hinge means 274. The other end portion of bucket 272, closer to section 10*b*, can be supported by a pair of support claws 276, on the side of base 270. Each claw 276 is mounted, for horizontal rotation, on claw shaft 278 which is attached to base 270, extending vertically. When supported by claws 276, as shown in FIG. 31, bucket 272 is kept horizontal. If it is in such a horizontal position, bucket 272 is provided with a pair of auxiliary rails 280, which are connected, with a predetermined gap, to paired rails 12 of upper path section 10*b*. Hydraulic cylinder 282 is disposed between base 270 and the underside of bucket 272. When support claws 276 are disengaged from bucket 272, cylinder 282 can withdraw its piston rod, thereby causing bucket 272 to rock around hinge means 274, as indicated by two-dot chain line in FIG. 31. Thus, auxiliary rails 280 of bucket 272 can be connected, with a predetermined gap, to paired rails 12 of lower path section 10*a*, in tubular path 10**.

According to delivery station 30 described above, when bucket 272 is kept horizontal, as shown in FIG. 31, car 40, driven along rails 12 of upper path section **10*b*, can be transferred from rails 12 to auxiliary rails 280 of bucket 272, and then led into the bucket. A braking system (not shown) is provided in bucket 272, whereby the incoming car is braked and stopped. This braking system may be of the same construction as the one attached to platform 14**.

After car 40 enters bucket 272, support claws 276 are disengaged from the bucket, and the piston rod of hydraulic cylinder 282 contracts. As a result, auxiliary rails 280 of bucket 272 are shifted, so as to be disconnected from rails 12 of upper path section 10*b*, and connected to the rails of lower path section 10*a*. At this point of time, the braking system of bucket 272 is still working, so that car 40 cannot be moved unexpectedly by gravity, before auxiliary rails 280 of bucket 272 are fully connected to rails 12 of path section 10*a*. When rails 280 and 12 are fully connected, the braking system is released, so that car 40 in bucket 272 is driven, in a backward-directed position, from bucket 272 toward path section 10*a*, to be transferred to rails 12 of section 10*a*. Thereafter, car 40 travels in the aforementioned manner. After the car is transferred from upper path section 10*b* to lower path section 10*a*, bucket 272 is returned to the horizontal position, as shown in FIG. 31.

The present invention is not limited to the first embodiment described above, and the following is a description of modified examples of the invention. In the description to follow, like reference numerals are used to designate like members as described in connection with the first embodiment.

Figure 33:
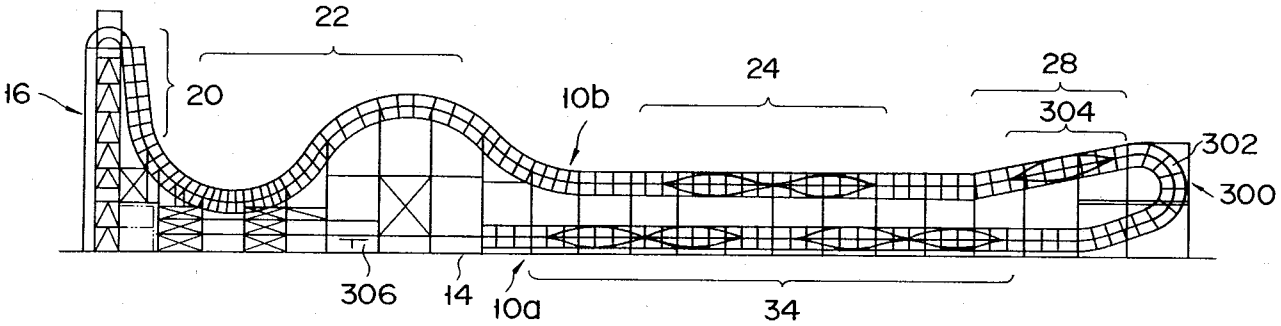
FIG. 33 is a schematic view showing an outline of an amusement ride system according to a second embodiment of the invention.
Figure 34:
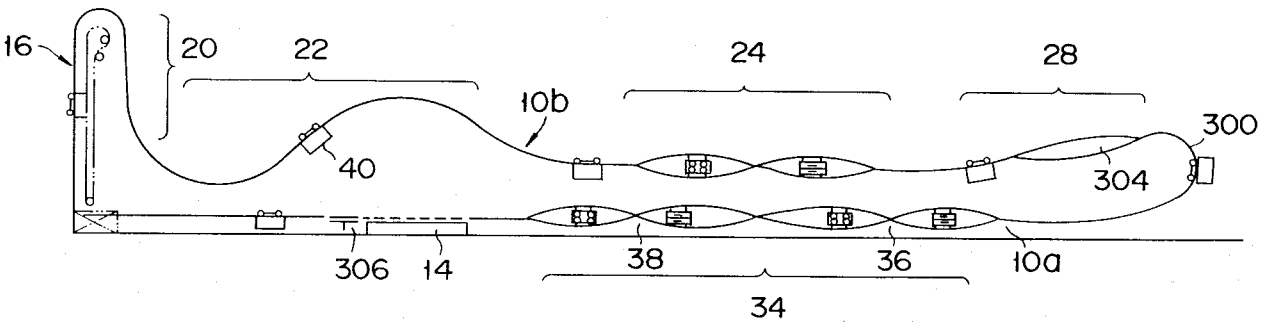
FIG. 34 is a schematic view for illustrating the way a passenger car of the system of FIG. 33 travels.

Referring now to FIGS. 33 and 34, there is shown a second embodiment of the invention. In this embodiment, curved path section 300, connecting upper and lower path sections 10*b* and 10*a*, is provided in place of delivery station 30. Path section 300, which has basically the same construction as path sections 10*b* and 10*a*, includes a pair of coupling rails 302 curved as shown in FIGS. 33 and 34, to connect rails 12 of sections 10*b* and 10*a*. In the second embodiment, moreover, rails 12 are twisted at incline portion 28 of upper path section 10*b*, so as to form twist region 304, in which passenger car 40 makes a half turn. Thus, when car 40 enters path section 300, from section 10*b*, it is caused to make a half turn by region 304. Accordingly, the car is inverted when it runs past section 300. In this case, passengers in car 40 can have a more thrilling experience, feeling as if they were falling headlong down. While car 40 is passing through path section 300, moreover, the passengers are held securely against their seats by centrifugal force.

In the second embodiment, curved path section 300 is used in place of delivery station 30, so that car 40 is in a forward-directed position when it enters lower path section 10*a*, after having run past section 300. Accordingly, car 40 is also in the forward-direction position when it returns to and stops at platform 14. When car 40 restarts from platform 14, therefore, its posture is opposite to that in the case of the first embodiment. Thus, in the second embodiment, turntable 306 is disposed between platform 14 and lift mechanism 16, as shown in FIGS. 33 and 34, whereby car 40 is reoriented.

Figure 35:
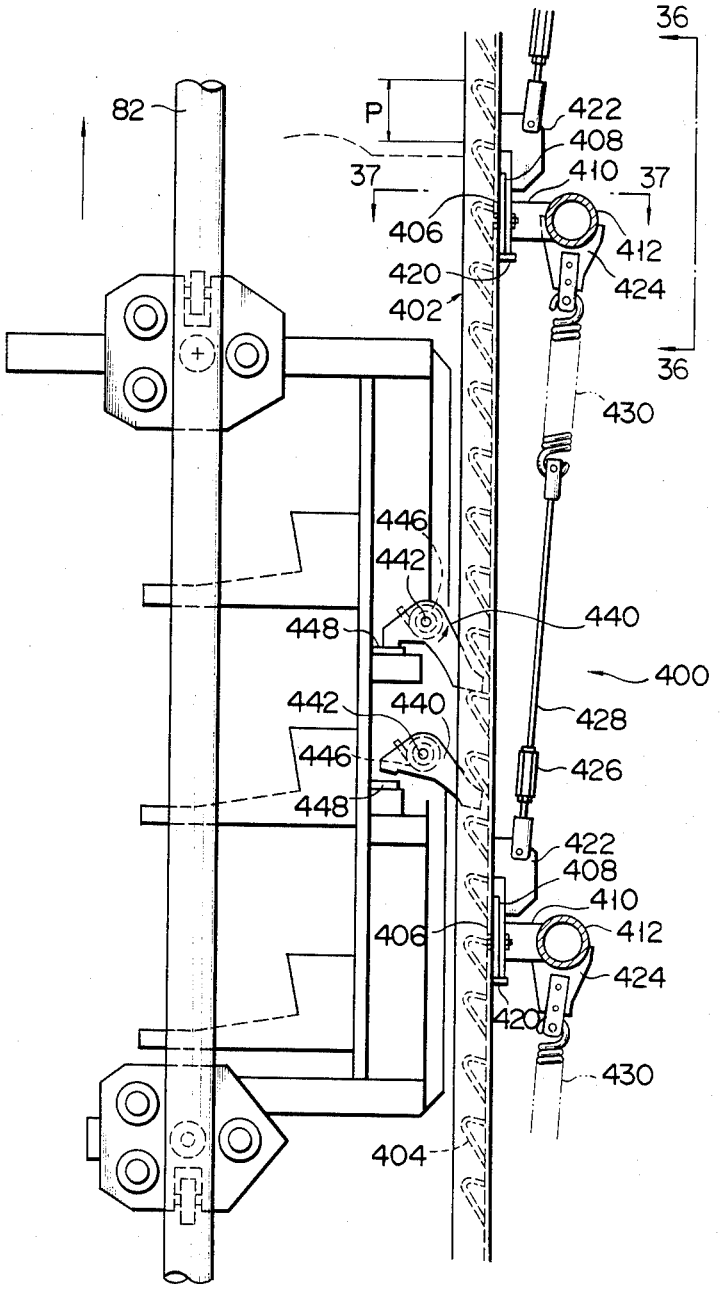
FIG. 35 is a side view showing part of a safety device according to a third embodiment of the invention.

Referring now to FIGS. 35 to 39, there is shown a third embodiment of the present invention. This embodiment is related to a modification of safety device 220, which has been described in connection with FIGS. 24 to 30. As shown in FIG. 35, safety device 400 of the third embodiment uses elongate rack 402, in place of emergency chain 110, which is used in the first embodiment. Rack 402 has a number of rack teeth 404, which are formed on that surface of the rack which faces the bottom surface of car 40, ascending along pull-up rails 82. Teeth 404 are arranged at predetermined pitches P, in the longitudinal direction of rack 402.

Figure 36:
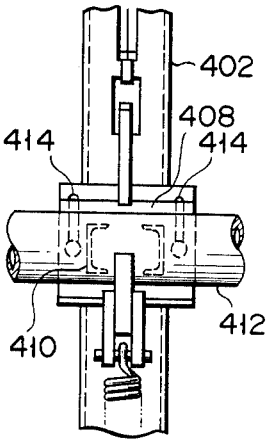
FIG. 36 is a partial view taken along line 36—36 of FIG. 35.
Figure 37:
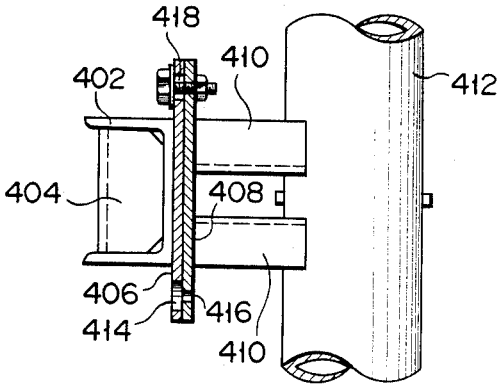
FIG. 37 is a sectional view taken along line 37—37 of FIG. 35.

A plurality of sliding plates 406, arranged at predetermined intervals in the longitudinal direction of rack 402, are fixed on the opposite side of rack 402 to rack teeth 404. Plates 406 slidably engage guide plates 408, individually. Plates 408 are coupled, by means of bracket 410 each, to pipe members or elements 412, which constitute support post 80 (FIG. 13) of lift mechanism 16. As seen from FIG. 35, elements 410 are arranged at regular intervals, in the longitudinal direction of rack 402. Referring to FIGS. 36 and 37, the relationship between plates 406 and 408 will be described. One of these two plates is formed with a pair of slots 414, extending vertically, as shown in FIG. 36. The other plate is formed with holes 416, corresponding in position to slots 414. Guide pin 418 is passed through each combination of slot 414 and hole 416, and fixed to guide plate 408. In this embodiment, as seen from FIG. 37, pins 418 are each formed of a stepped bolt. Bolt 418 is fixed to plate 408 by means of a nut. It is prevented from coming off sliding plate 406, by its own head. Thus, coupled to support post 80 by means of plates 408 and pins 418, rack 402 can move vertically through a distance, which is determined by the length of slots 414. As shown in FIG. 35, moreover, stopper 420 is fixed to the lower end of each sliding plate 406. It can restrain the rack from moving upward, by engaging the lower end of its corresponding guide plate 408.

A number of brackets 422 are fixed to the back of rack 402, on which sliding plates 406 are fixed, so as to be located near the top of their corresponding elements 412. Each bracket 422 is paired with bracket 424, which is fixed to that element 412 which is located just above bracket 422. Tension coil spring 430 is anchored between each pair of brackets 422 and 424, with the aid of turnbuckle 426 and rod 428, arranged upward. In this manner, rack 402 is supported on support post 80 by means of a number of springs 430. Thus, such a supporting structure for rack 402 can disperse the weight of rack 402, acting on post 80, and load from car 40, which is exerted on rack 402 in the manner mentioned later.

Figure 38:
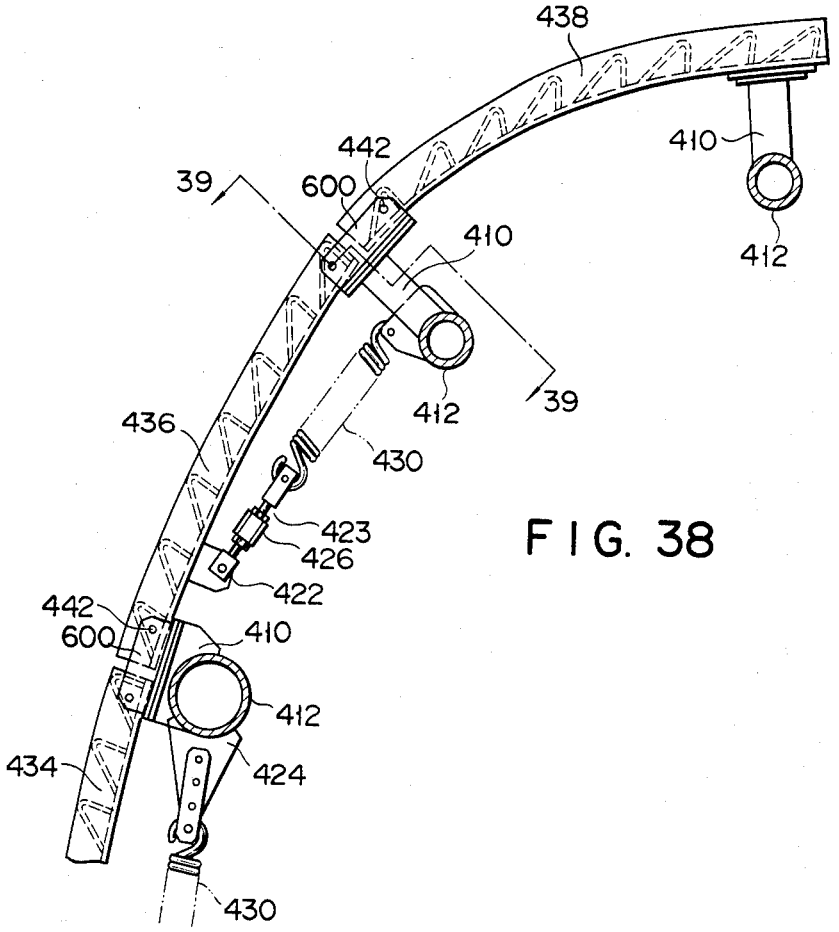
FIG. 38 is a side view showing the upper portion of a rack shown in FIG. 35.
Figure 39:
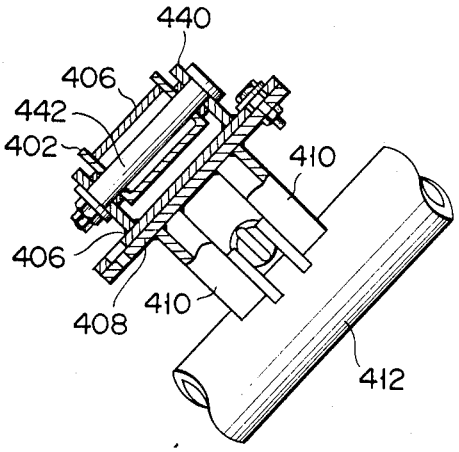
FIG. 39 is a sectional view taken along line 39—39 of FIG. 38.

Rack 402, which replaces emergency chain 110 of the first embodiment, has its top portion curved, as shown in FIG. 38. Namely, the top portion of the rack includes first, second, and third curved portions 434, 436 and 438, arranged from bottom to top, in the order named. The lower end of first curved portion 434 is coupled to the upper end of a straight portion (not shown) of rack 402. The upper end of portion 434 and the lower end of second curved portion 436 are connected to each other, by means of coupling bracket 600 and a pair of coupling pins 442. Second and third curved portions 436 and 438, like the first and second ones, are connected with each other, by means of coupling bracket 600 and a pair of coupling pins 442. Each bracket 600 is coupled to support post 80 by means of sliding plate 406, guide plate 408, and bracket 410.

It is to be understood that rack teeth 404, at first to third curved portions 434, 436 and 438, are arranged at pitch P. First and second portions 434 and 436 are curved so that their radius of curvature varies gradually. On the other hand, third portion 438 has a fixed radius of curvature. Preferably, therefore, sliding plates 406 and guide plates 408, connected to coupling brackets 600, are also curved in accordance with the curved configuration of the first to third curved portions. Further, the contacting surface of bracket 410 of third curved portion 438 is also curved in accordance with the configuration of third curved potion 638.

As shown in FIG. 35, a pair of rack detents 440, which can engage rack teeth 404 of rack 402, are rockably mounted on the bottom portion of car 40, by means of detent shafts 442, individually. Detents 440 are urged to rock counterclockwise, around their respective shafts 442, by torsion coil springs 446, individually. Further, a pair of stoppers 448, for stopping detents 440 from rocking, are fixed to the bottom portion of car 40, whereby the extreme ends of detents 440 project from the bottom surface of car 40, thus engaging rack 402.

As seen from FIG. 35, paired rack detents 440 are arranged at a predetermined distance, in the longitudinal direction of car 40. Distance S between detents 440 is given by $S=P\cdot n+P/2$, where P is the pitch of rack teeth 404 of rack 402, and n is any one of natural numbers, including zero. If the number of detents 440 provided is m (m: natural number larger than 2), distance S can be expressed by $S=P\cdot n+P/m$.

According to safety device 400 of the third embodiment, as described above, rack detents 440 ascend together with car 40, while getting over rack teeth 404 of rack 402 successively, as the car is moved up by lift mechanism 16. If pull-up chain 86 should be disengaged from hook mechanism 180 of car 40 (FIG. 21), during the ascending process, the car would start to drop by gravity. In such a case, however, one of rack detents 440 of safety device 400 engages one of the teeth 404 of rack 402, as shown in FIG. 35, thereby preventing car 40 from rolling back. Since distance S between detents 440 is $S=P\cdot n+P/2$, the distance through which car 40 drops or moves backward, until the rack detent engages one of rack teeth 404, can be limited to less than half of pitch P of teeth 404. Thus, the back-run distance or so that the dropping speed of car 40 can be reduced, so that an impact, transmitted from the car to rack 402 through teeth 404, can be lessened.

As mentioned before, moreover, rack 402 is elastically supported on support post 80, only for vertical movement, by means of sliding plates 406, guide plates 408, and tension coil springs 430. Therefore, when the impact is transmitted from car 40 to rack 402 through rack detents 440, during the back run of the car, the rack is moved downward, against the urging force of springs 430. Accordingly, the impact on rack 402, attributable to the back run, can be further relieved. Thus, rack detents 440 of safety device 400 can be prevented from cutting into rack teeth 404 of the rack.

Referring now to FIGS. 40 to 45, there is shown a fourth embodiment of the present invention. This embodiment relates to an improvement of car 40 and paired rails 12, as compared with platform 14. Rails 12 can be a substantial obstacle to passengers' getting on and off car 40, at platform 14. In order to guide car 40 up to platform 14, rails 12 of lower path section **10*a* extends to the platform, and are located at a predetermined height above the bottom surface of the car, as seen from FIG. 6. Therefore, the passengers, getting in and out of car 40, at platform 14, must avoid rails 12 by passing under them, causing inconvenience. In getting in and out of the car, moreover, a passenger may possibly have his clothes or the like caught by the rail 12**.

Figure 40:
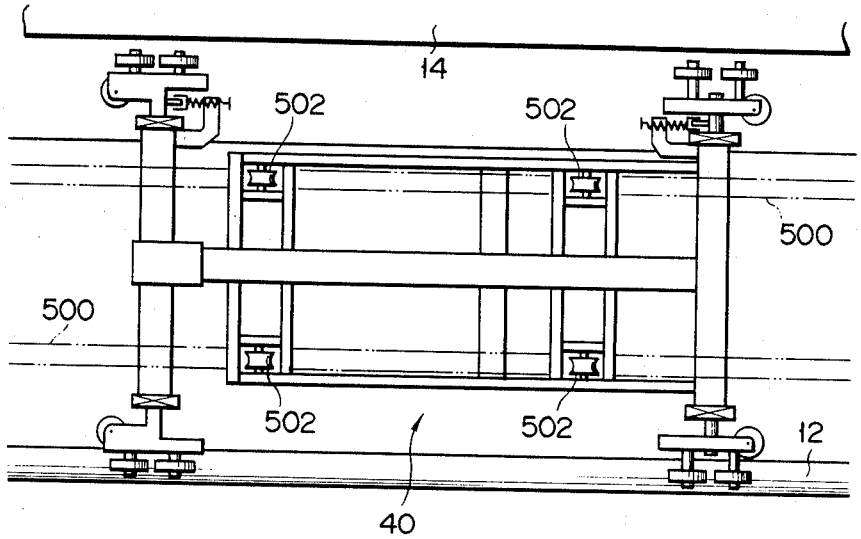
FIG. 40 is a schematic view showing positions of auxiliary rails for guiding a passenger car, traveling in the region of a platform, according to a fourth embodiment of the invention.

In consideration of these circumstances, according to the fourth embodiment, that rail 12 on the side of platform 14 is partially cut, corresponding to the platform, as shbwn in FIG. 40. If one of the rails is cut at platform 14, in this manner, car 40, at the region, can be guided only by the other rail, and cannot maintain its predetermined posture as it enters the platform.

Figure 41:
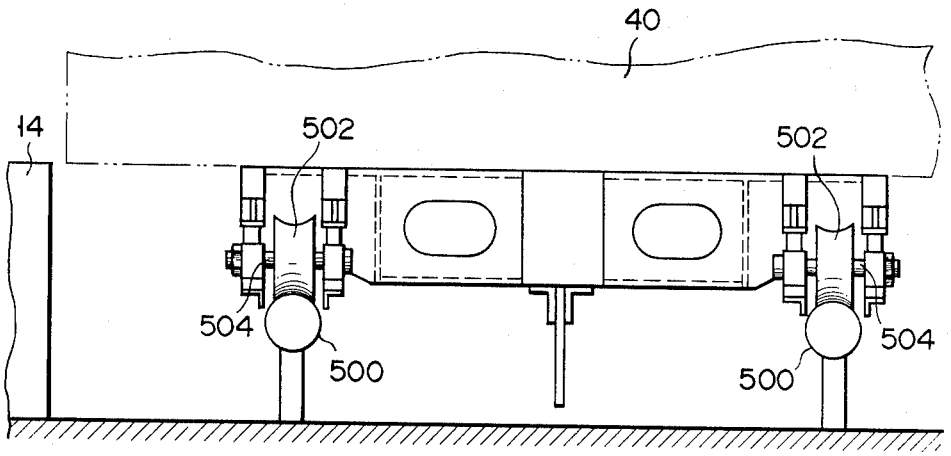
FIG. 41 is a schematic view showing the relative positions of the auxiliary rails and platform.
Figure 42:
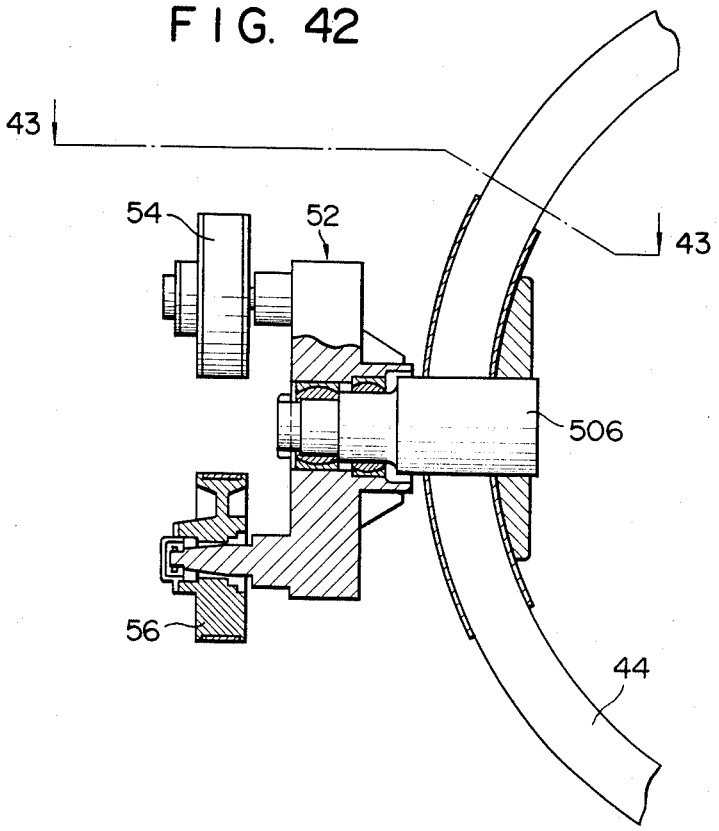
FIG. 42 is a schematic view showing the relative positions of a front frame and a wheel unit of the car.

To avoid this, according to the fourth embodiment, a pair of auxiliary rails 500 are laid corresponding to the region of platform 14, as shown in FIGS. 40 and 41. They extend parallel to each other, along platform 14. Four auxiliary wheels 502, adapted to be in rolling contact with rails 500, are attached to the bottom of car 40 by means of shafts 504, individually. Thus, when car 40 enters platform 14, wheels 502 of the car are guided on the auxiliary rails. Despite the absence of one of rails 12 at the region of platform 14, therefore, car 40 can be guided smoothly to the platform. It is to be understood that car 40, entering platform 14, is guided not only by auxiliary rails 500, but also by the other of rails 12.

Figure 43:
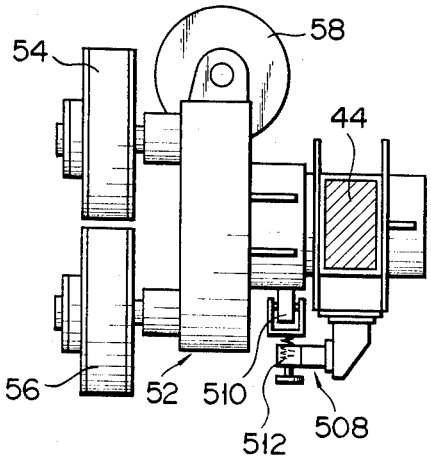
FIG. 43 is a sectional view taken along line 43—43 of FIG. 42.
Figure 44:
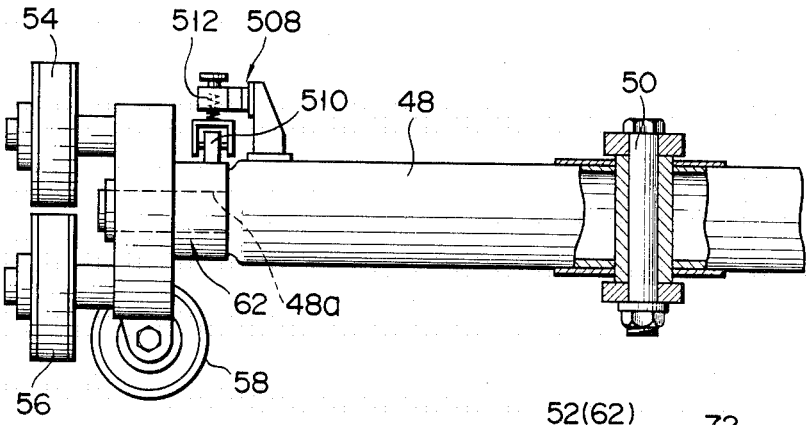
FIG. 44 is a schematic view showing the relative positions of a cross frame and the wheel unit of the car.

As described before, in connection with FIGS. 6 and 7, wheel units 52 and 62 of car 40 are rotatably mounted on the car, in order to run smoothly on rails 12, following the curvature of rails 12. As seen from FIG. 42, front wheel unit 52 is rotatably mounted on ring-shaped front frame 44 by means of shaft 506. As shown in FIG. 44, on the other hand, rear wheel unit 62 is rotatably mounted on shaft portion **48*a*, which is formed at an end of cross frame 48. In this case, if one of rails 12 is cut at the region of platform 14, as aforesaid, wheel units 52 and 62 of car 40, which originally were to travel on the now cut rail, may rotate in vain. If wheel units 52 and 62 rotate in this manner, they will not be able to be led individually onto the coupling rails of travel guide unit 18, in restarting car 40 from platform 14, thereafter. According to the fourth embodiment, therefore, front and rear wheel units 52 and 62 are each provided with rotation-preventing mechanism 508, as shown in FIGS. 43 and 44. Mechanism 508 serves to prevent its corresponding wheel unit from rotating in vain on the side of the cut rail when car 40 enters platform 14**.

Figure 45:
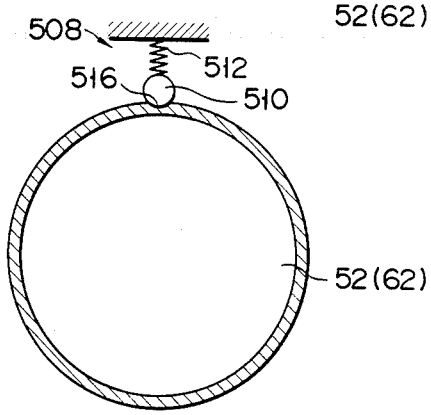
FIG. 45 is a schematic view of a detent mechanism.

Rotation-preventing mechanism 508 includes roller 510, in rolling contact with the peripheral surface of the wheel unit, and compression coil spring 512 for pressing roller 510 against the peripheral surface of the wheel unit. As shown in FIG. 45, the peripheral surfaces of wheel units 52 and 62 are formed with arcuate groove 516, in which roller 510 is fitted.

According to rotation-preventing mechanism 508, as described above, when car 40 enters platform 14, roller 510 of each wheel unit is located in groove 516, thereby preventing the wheel unit from rotating unnecessarily.

When car 40 travels in upper and lower path sections **10*b* and 10*a*, front and rear wheel units 52 and 62 are subjected to a great moment, which is attributable to the curved configuration of rails 12, at path sections 10*b* and 10*a*. This moment pushes up roller 510, against the urging force of spring 512, thereby disengaging the roller from groove 516. Thus, wheel units 52 and 62 can rotate, following the curvature of rails 12**.

Figure 46:
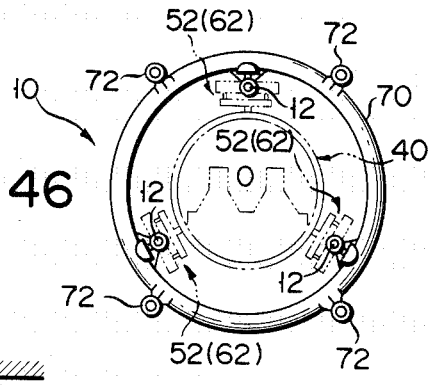
FIG. 46 is a sectional view of a tubular path.

FIG. 46 shows the fifth embodiment of the present invention. In this embodiment, tubular path 10 comprises three rails 12. These rails are arranged at regular intervals in the circumferential direction of ring-shaped ribs 70. Thus car 40 is provided with three wheel units at both the front and rear sides.

What is claimed is:

1. An amusement ride system, comprising:

(a) a plurality of rails arranged around a central axis haivng a predetermined configuration, said rails being separated from one another at a uniform distance;

(b) a plurality of ring-shaped ribs arranged along said rails at predetermined intervals and surrounding said rails in such a manner as to support said rails, said ribs defining a tubular path, further including at least one twist region formed by twisting said rails around said central axis while maintaining said uniform distance between said rails; and (c) a passenger car for traveling on said rails along said tubular path, including a car body situated between said rails and having an axis extending in a traveling direction of said car, said pasenger car further including wheel means permitting said car body to travel along said rails while being held by said rails and for twisting the car around the axis which extends in the traveling direction when said car is traveling through said twist region of said rails, said wheel means including front and rear wheel units arranged on each side of the car body such that the wheels are spaced from each other, as viewed in the traveling direction of the car, each wheel unit having a set of wheels which are in rolling contact with a rail so as to hold said rail therebetween, two wheel sets being respectively mounted to two ends of a support arm extending perpendicular to an axial direction of the car body, the support arm being coupled to the car body such that it is rotatable around the axis of the car body.

2. The system according to claim 1, wherein said tubular path includes a plurality of coupling beams, extending along the path and connecting the ring-shaped ribs, said coupling beams being arranged on the outer

3. The system accordino to claim 1 peripheral surface of each rib, at predetermined intervals in the circumferential direction of the rib. wherein said tubular path includes a lower path section located close to the ground, an upper path section located higher than said lower path section, so as to be connectible, at one end, with the lower path section, one end of the upper path section being connected to the lower path section and an opposite end thereof being situated at the highest portion of said tubular path.

4. The system according to claim 3, further comprising: lift means for pulling the car from the lower path section to the opposite end of the upper path section.

5. The system according to claim 4, wherein said lift means includes a support post extending upward; a plurality of pull-up rails, extending along and supported by the support post, whereby the individual wheel units of the car are guided, the upper end of each said pull-up rail being connected to its corresponding rail of the upper path section; a pull-out chain extending along the pull-up rails; drive means for driving the pull-up chain; and hook means attached to the car and adapted to engage one of pins which connect links of the pull-up chain, whereby the car is hoisted as pull-up chain runs.

6. The system according to claim 5, wherein said hook means includes a hook, rotatably mounted on the car, and adapted to selectively engage a pin of the pull-up chain, while rotating; and actuator means for driving the hook, thereby controlling the engagement between the hook and the pull-up chain, said actuator means including a hydraulic cylinder for rotating the hook.

7. The system according to claim 6, wherein said hydraulic cylinder is of a double-rod type, including a pair of piston rods extending in opposite directions, one of said piston rods being coupled to the hook; and said actuator means further includes spring means for urging the hook to rock in the direction to engage the pull-up chain, a directional control valve for controlling the connection between two pressure chambers in the hydraulic cylinder, divided by the piston, and switching means for switching the directional control valve in predetermined positions of the car, while the car is moving along the pull-up rails and the rails of the upper path section.

8. The system according to claim 5, wherein said lift means further includes safety means for preventing the car from dropping, while ascending along the pull-up rails.

9. The system according to claim 8, wherein said safety means includes an endless emergency chain, extending parallel to the pull-up chain and normally at a standstill; a sprocket rotatably mounted on the car and adapted to engage one of pins which connect links of the emergency chain, when the car ascends along the pull-up rails; and a one-way clutch allowing the sprocket to rotate in one direction, thereby permitting the ascent of the car, and preventing the sprocket from rotating in the opposite direction.

10. The system according to claim 8, wherein said safety means includes an elongate rack member extending upward along the pull-up chain and vertically elastically supported on the support post, said rack member having rack teeth formed at predetermined pitch; and at least one rack detent attached to the car and adapted, in cooperation with the teeth of the rack member, to allow the car to ascend and prevent the car from descending, when the car ascends along the pull-up rails.

11. The system according to claim 10, wherein said car is formed with a pair of rack detents spaced in the longitudinal direction of the rack member when the car ascends along the pull-up rails, distance S between the rack detents being given by $$S=P\cdot n+P/2,$$

where P is the pitch of the rack teeth of the rack member, and n is any of natural numbers including zero.

12. An amusement ride system according to claim 3, wherein the upper path section is located directly above the lower path section, and the platform is located along the lower path section.

13. An amusement ride system according to claim 1, further comprising a platform from which the passengers enter and exit the car, and wherein the rail means further includes a cutaway region for facilitating the passengers' entrance to and exit from the car, the cutaway region being formed by cutting away one of the paired rails extending along the platform, the car further including means for preventing rotation of each of the wheel units when the car is travel1ing through the cutaway region of the rail menas, and the rail means further including auxiliary means for permitting the car to pass through the cutaway region of the rail means while maintaining the same posture as it has immediately before it enters the cutaway region.

14. An amusement ride system according to claim 1, wherein each of the wheel units is rotatable with reference to the car body of the car such that it can travel along the corresponding rail, following curvature of the rail.

15. An amusement ride system according to claim 14, wherein the auxiliary means includes a plurality of auxiliary wheels mounted on a bottom of the car, and a pair of auxilary rails, extending in parallel relationship to each other along the platform, for supporting the car through use of the auxiliary wheels and guiding the traveling of the car, and wherein the rotation-preventing means for the car body includes:

(a) a roller in rolling contact with a circumference of the wheel unit;

(b) a compression spring for urging the roller against the circumference of the wheel unit; and (c) one groove provided in the circumference of the wheel unit and engageable with the roller, the groove being in the form of an arc such that it can be disengaged from the roller, against the urging force of the compression spring, when the car passes through the twist region of the rail means and such that it can hold engagement with the roller when the car passes through the cutaway region of the rail means.

* * * * *

UNITED STATES PATENT AND TRADEMARK OFFICE

CERTIFICATE OF CORRECTION

PATENT NO. : 4,724,771

DATED : February 16, 1988

INVENTOR(S) : Yamada Kazuo

It is certified that error appears in the above-identified patent and that said Letters Patent are hereby corrected as shown below:

In claim 2, column 17, line 32, insert the following after the word "outer": --peripheral surface of each rib, at predetermined intervals in the circumferential direction of the rib.--

In claim 3, column 17, line 33, delete "accordino" and substitute --according--.

In claim 3, column 17, lines 33-35, delete "peripheral surface of each rib, at predetermined intervals in the circumferential direction of the rib."

In claim 5, column 17, line 52, delete "pull-out" and substitute --pull-up--.

In claim 13, column 18, line 55, delete "menas" and substitute --means--.

In column 15, line 67, delete "shbwn" and substitute "shown".

Signed and Sealed this

Seventh Day of March, 1989

*Attest:*

DONALD J. QUIGG

*Attesting Officer*

*Commissioner of Patents and Trademarks*